US011815105B2

(12) United States Patent
Oakman

(10) Patent No.: US 11,815,105 B2
(45) Date of Patent: Nov. 14, 2023

(54) REGENERATIVE BLOWERS-COMPRESSORS WITH SHAFT BYPASS FLUID RE-VENTS

(71) Applicant: VICTORI, LLC, Boulder, CO (US)

(72) Inventor: Joel Jack Oakman, Lakewood, CO (US)

( * ) Notice: Subject to any disclaimer, the term of this patent is extended or adjusted under 35 U.S.C. 154(b) by 640 days.

(21) Appl. No.: 16/446,541

(22) Filed: Jun. 19, 2019

(65) Prior Publication Data

US 2020/0032812 A1 Jan. 30, 2020

Related U.S. Application Data

(60) Provisional application No. 62/660,644, filed on Apr. 20, 2018.

(51) Int. Cl.
*F04D 29/44* (2006.01)
*F04D 23/00* (2006.01)

(52) U.S. Cl.
CPC ..... *F04D 29/441* (2013.01); *F04D 23/008* (2013.01)

(58) Field of Classification Search
CPC ..... F04D 23/008; F04D 27/0207–0238; F04D 29/441; F04D 29/10–146; F04D 5/002; F04D 5/003; F04D 5/005; F04D 5/006; F04D 5/007; F04D 5/008
See application file for complete search history.

(56) References Cited

U.S. PATENT DOCUMENTS 2,574,724 A 11/1951 Baker
2,684,034 A * 7/1954 Roth ..... F04D 29/588 415/115
3,558,236 A * 1/1971 Bylsma ..... F04D 5/002 415/55.1
4,405,134 A 9/1983 Sargent et al.
(Continued)

FOREIGN PATENT DOCUMENTS

GB 2200405 A1 8/1988

OTHER PUBLICATIONS

Form PCT/ISA/210 International Search Report and Form PCT/ISA/237 Written Opinion of the International Searching Authority from counterpart International Patent Application No. PCT/US19/38064, which claims priority to U.S. Appl. No. 16/446,541.

*Primary Examiner* — Elton K Wong
(74) *Attorney, Agent, or Firm* — Parsons & Goltry, PLLC; Michael W. Goltry; Robert A. Parsons

(57) ABSTRACT

A regenerative blower-compressor includes an impeller mounted to a drive shaft within a housing including a channel extending from an inlet adjacent to a low fluid-pressure region of the channel to an outlet adjacent to a high fluid-pressure region of the channel, the impeller extends radially outward through an annular volume within the housing from the drive shaft to blades in the channel and is configured to rotate for rotating the blades through the channel for forcing fluid through the channel from the inlet to the outlet in response to rotation of the drive shaft, the drive shaft extends from the impeller within the annular volume to into a shaft chamber within the housing configured to receive fluid from the high fluid-pressure region of the channel, and a port configured to vent fluid directly from the shaft chamber to into the low fluid-pressure region of the channel.

9 Claims, 8 Drawing Sheets

(56) References Cited

U.S. PATENT DOCUMENTS

| | | | | |
|---|---|---|---|---|
| 4,556,363 | A * | 12/1985 | Watanabe | F04D 5/005 415/55.6 |
| 6,244,841 | B1 * | 6/2001 | Schofield | F04C 18/344 418/104 |
| 9,086,071 | B2 * | 7/2015 | Schofield | F04D 5/008 |
| 2013/0251514 | A1 | 9/2013 | Oakman | |

* cited by examiner

REGENERATIVE BLOWERS-COMPRESSORS WITH SHAFT BYPASS FLUID RE-VENTS

CROSS-REFERENCE TO RELATED APPLICATION

This application claims the benefit of U.S. Provisional Application No. 62/660,644, filed Apr. 20, 2018.

FIELD OF THE INVENTION

The present invention relates to regenerative blowers-compressors.

BACKGROUND OF THE INVENTION

Regenerative blowers-compressors are useful for moving large volumes of fluid, such as air and other gases, at pressures or vacuums comparatively lower than typical compressors, and comparatively higher than centrifugal fans. Unlike positive displacement compressors with their complex assembly and high parts count, and turbo compressors with their high operating speeds, regenerative blowers, also referred to as side channel blowers, are comparatively simple and medium speed machines that regenerate the pressure cycles of their bladed impellers continuously from an inlet to an outlet to create vacuum or pressure. Regenerative blowers are long-lasting, inherently simple in construction, low in cost, and commonly employed used in a wide range of applications where high fluid flow and low vacuum/pressure are required, such as pneumatic conveying, sewage aeration, vacuum lifting, vacuum packaging, packing equipment, printing presses, aquaculture/pond aeration, spas, dryers, dust/smoke removal, industrial vacuum systems, soil vapor extraction and chip removal for engraving equipment. The inherent advantages of regenerative blowers could be applied to an expanded range if the pressure and efficiency could be increased and the size decreased from standard pressures, efficiencies, and sizes. In particular, regenerative blowers have been shown to have ideal characteristics for fuel cell air supply systems and similar applications that achieve high efficiency while keeping the fluid stream free of contaminants such oil and grease from the bearings necessary to support the drive shaft.

A typical regenerative blower includes an impeller mounted directly to a motor shaft, which spins at the motor's speed, typically about 3,000 revolutions per minute, and in some cases up to 30,000 revolutions per minute. The impeller consists of numerous blades formed on its circumference. The number, size, spacing, angle, and specific shape of these blades contribute to the pneumatic performance characteristics of the blower. The impeller spins within a housing assembly having a channel on the inside of the housing that follows a radial path around the circumference of the impeller between an inlet and an outlet. As the impeller rotates, the fluid, such as air or other gas, is forced through the channel from the inlet to the outlet. The fluid is pressurized as it passes through the channel from the inlet to the outlet, whereby the fluid discharged through the outlet is at a higher relative pressure than that of the fluid entering the channel through the inlet. The intake region of the channel near the inlet is the low-pressure region of the blower, and the discharge region of the channel near the outlet is the high-pressure region of the blower. As the fluid is forced through the channel from the inlet to the outlet, the fluid is captured between each blade of the impeller and is pushed both outward and forward into the channel. The fluid follows the inner shape of the housing in a toroidal manner and returns to the base of the blade. The regeneration process is repeated over and over as the impeller spins, which gives the blower it's pressure/vacuum capabilities. A regenerative blower operates like a staged reciprocal compressor. While each blade-to-blade regeneration results in only a slight pressure increase, the sum of the slight pressure increases through the channel from the inlet to the outlet compound to yield comparatively high continuous operating pressures (in some cases over 10 psig) more commonly associated with more complex compressors, hence the designation, regenerative blowers-compressors. As in so many cases where a step change in the typical performance of a known technology is achieved, new deficiencies and new opportunities for both correction and new features become evident.

Regenerative blowers are used to compress compressible fluids such as air and pump incompressible liquids such as water and or fuel. Accordingly, regenerative blowers are, by definition, regenerative compressors. The terms "regenerative blower" and "regenerative compressor" are, therefore, interchangeable. The fluid normally lost is a byproduct of compression within the compressor and is typically dealt with in a number of ways. Methods include allowing the fluid to pass through the compressor into the motor housing either pressurizing the motor housing or the fluid is allowed to pass through the motor housing and subsequently vented to atmosphere. Another technique attempts to eliminate the bypass fluid by placing a seal between the shaft and compressor housing eliminating the leak path.

Each method has drawbacks. In the case of allowing the fluid to pressurize the motor housing, the pressurized fluid can drive grease or oil from the motor bearings. In a similar manner, the fluid contained in the motor housing can be re-injected into the fluid path when the pressures in the compressor drop to lower values. If the fluid has encountered oil or grease in the motor housing the reintroduced fluid can be detrimental in certain devices which rely on clean compressed fluid such as medical devices or fuel cell stacks.

In the case of shaft seals, they come in both tight clearance non-contact types, and contact types. Non-contact seals are preferred in applications requiring high efficiency due to low friction, but the clearance creates leakage. Lower clearances can reduce, but not eliminate, leakage, at the penalty of tighter tolerances and higher costs.

Contact seals typically employ a compliant low friction material such as rubber or plastic that is in contact with the turning shaft to reduce leakage to very low levels. However, the resulting friction lowers compressor efficiency, and seal wear limits ultimate service life. Furthermore, a seal failure will allow fluid into the motor and bearings possibly washing the grease form the bearings and subsequently into the pressurized fluid stream. In the case of corrosive fluids, the fluid may damage the bearing and motor components.

Accordingly, it would be highly desirable to provide regenerative blowers-compressors that allow clearance seals to retain their advantages of low friction, long life and low cost, while generating leakage rates closer to non-clearance seals. In the case of clearance seals, it would also be highly desirable to provide regenerative blowers-compressors designed to have low leakage and pressure compensation for providing reduced seal wear and friction during low pressure operation.

SUMMARY OF THE INVENTION

According to the principle of the invention, a regenerative blower-compressor includes an impeller mounted to a drive shaft within a housing including a channel extending from an inlet adjacent to a low fluid-pressure region of the channel to an outlet adjacent to a high fluid-pressure region of the channel, the impeller extends radially outward through an annular volume within the housing from the drive shaft to blades in the channel, the impeller is configured to rotate for rotating the blades through the channel for forcing fluid through the channel from the inlet to the outlet in response to rotation of the drive shaft, the drive shaft extends from the impeller within the annular volume to into a shaft chamber within the housing, and the shaft chamber is configured to receive fluid leaked through the housing to into the shaft chamber from the high fluid-pressure region of the channel, and a port coupled in fluid communication directly between the shaft chamber and the low fluid-pressure region of the channel for venting fluid directly from the shaft chamber to into the low fluid-pressure region of the channel. The shaft chamber is defined by a sidewall extending between an end wall and a bearing rotatably connecting the drive shaft to the housing, the drive shaft is sealed to the sidewall by a radial shaft seal within the shaft chamber thereby dividing the shaft chamber into a first volume between the end wall and the radial shaft seal and a second volume between the bearing and the radial shaft seal, the first volume is configured to receive fluid leaked through the housing to into the first volume from the high fluid-pressure region of the channel, and the port is coupled in fluid communication directly between the first volume of the shaft chamber and the low fluid-pressure region of the channel. The first volume is greater than the second volume.

According to the principle of the invention, a regenerative blower-compressor includes an impeller mounted to a drive shaft within a housing including a channel extending from an inlet adjacent to a low fluid-pressure region of the channel to an outlet adjacent to a high fluid-pressure region of the channel, the impeller extends radially outward through an annular volume within the housing from the drive shaft to blades in the channel, the impeller is configured to rotate for rotating the blades through the channel for forcing fluid through the channel from the inlet to the outlet in response to rotation of the drive shaft, the drive shaft extends from the impeller within the annular volume to into a shaft chamber within the housing, the shaft chamber is defined by a sidewall extending between an end wall and a bearing rotatably connecting the drive shaft to the housing, the drive shaft is sealed to the sidewall by a radial shaft seal within the shaft chamber thereby dividing the shaft chamber into a first volume between the end wall and the radial shaft seal and a second volume between the bearing and the radial shaft seal, and the first volume is configured to receive fluid leaked through the housing to into the first volume from the high fluid-pressure region of the channel, a first port coupled in fluid communication directly between the high fluid-pressure region of the channel and the second volume for venting fluid directly from the high fluid-pressure region of the channel to into the second volume, and a second port coupled in fluid communication directly between the first volume and the low fluid-pressure region of the channel for venting fluid directly from the first volume to into the low fluid-pressure region of the channel. The first volume is larger than the second volume.

According to the principle of the invention, a regenerative blower-compressor includes an impeller mounted to a drive shaft within a housing including a channel extending from an inlet adjacent to a low fluid-pressure region of the channel to an outlet adjacent to a high fluid-pressure region of the channel, the impeller extends radially outward through an annular volume within the housing from the drive shaft to blades in the channel, the impeller is configured to rotate for rotating the blades through the channel for forcing fluid through the channel from the inlet to the outlet in response to rotation of the drive shaft, and the drive shaft extends from the impeller within the annular volume to into a shaft chamber within the housing, a first port coupled in fluid communication directly between the high fluid-pressure region of the channel and the shaft chamber for venting fluid directly from the high fluid-pressure region of the channel to the shaft chamber, and a second port coupled in fluid communication directly between the shaft chamber and the low fluid-pressure region of the channel for venting fluid directly from the shaft chamber to into the low fluid-pressure region of the channel.

According to the principle of the invention, a regenerative blower-compressor includes an impeller mounted to a drive shaft within a housing including a channel extending from an inlet adjacent to a low fluid-pressure region of the channel to an outlet adjacent to a high fluid-pressure region of the channel, the impeller extends radially outward through an annular volume within the housing from the drive shaft to blades in the channel, the impeller is configured to rotate for rotating the blades through the channel for forcing fluid through the channel from the inlet to the outlet in response to rotation of the drive shaft, the drive shaft extends from the impeller within the annular volume to into a shaft chamber within the housing, the shaft chamber is defined by a sidewall extending between an end wall and a bearing rotatably connecting the drive shaft to the housing, and the drive shaft is sealed to the sidewall by a radial shaft seal within the shaft chamber thereby dividing the shaft chamber into a first volume between the end wall and the radial shaft seal and a second volume between the bearing and the radial shaft seal, a first port coupled in fluid communication directly between the high fluid-pressure region of the channel and the first volume for venting fluid directly from the high fluid-pressure region of the channel to the first volume, and a second port coupled in fluid communication directly between the first volume and the low fluid-pressure region of the channel for venting fluid directly from the first volume to into the low fluid-pressure region of the channel. A third port is coupled in fluid communication directly between the high fluid-pressure region of the channel and the second volume for venting fluid directly from the high fluid-pressure region of the channel to the second volume, and the second port additionally coupled in fluid directly between the second volume and the low fluid-pressure region of the channel for venting fluid directly from the second volume to into the low fluid-pressure region of the channel. the first volume is larger than the second volume.

According to the principle of the invention, a regenerative blower-compressor includes an impeller mounted to a drive shaft within a housing including a channel extending from an inlet adjacent to a low fluid-pressure region of the channel to an outlet adjacent to a high fluid-pressure region of the channel, the impeller extends radially outward through an annular volume within the housing from the drive shaft to blades in the channel, the impeller is configured to rotate for rotating the blades through the channel for forcing fluid through the channel from the inlet to the outlet in response to rotation of the drive shaft, the drive shaft extends from the impeller within the annular volume to into a shaft chamber within the housing, the shaft chamber is defined by a sidewall extending between an end wall and a bearing rotatably connecting the drive shaft to the housing, and the drive shaft is sealed to the sidewall by a radial shaft seal within the shaft chamber thereby dividing the shaft chamber into a first volume between the end wall and the radial shaft seal and a second volume between the bearing and the radial shaft seal, a first port coupled in fluid communication directly between the high fluid-pressure region of the channel and the second volume for venting fluid directly from the high fluid-pressure region of the channel to the second volume, and a second port coupled in fluid communication directly between the second volume and the low fluid-pressure region of the channel for venting fluid directly from the second volume to into the low fluid-pressure region of the channel. The first volume is larger than the second volume.

According to the principle of the invention, a regenerative blower-compressor includes an impeller mounted to a drive shaft within a housing including a channel extending from an inlet adjacent to a low fluid-pressure region of the channel to an outlet adjacent to a high fluid-pressure region of the channel, the impeller extends radially outward through an annular volume within the housing from the drive shaft to blades in the channel, the impeller is configured to rotate for rotating the blades through the channel for forcing fluid through the channel from the inlet to the outlet in response to rotation of the drive shaft, the drive shaft extends from either side of the impeller within the annular volume to into a first shaft chamber and a second shaft chamber within the housing on either side of the impeller, and the first shaft chamber and the second shaft chamber are each configured to receive fluid leaked through the housing to into the first shaft chamber and the second shaft chamber from the high fluid-pressure region of the channel, a first port coupled in fluid communication directly between the first shaft chamber and the low fluid-pressure region of the channel for venting fluid directly from the first shaft chamber to into the low fluid-pressure region of the channel, and a second port coupled in fluid communication directly between the second shaft chamber and the low fluid-pressure region of the channel for venting fluid directly from the second shaft chamber to into the low fluid-pressure region of the channel. The first shaft chamber is defined by a sidewall extending between the impeller and a bearing rotatably connecting the drive shaft to the housing, the drive shaft is sealed to the sidewall by a radial shaft seal within the first shaft chamber thereby dividing the first shaft chamber into a first volume between the impeller and the radial shaft seal and a second volume between the radial shaft seal and the bearing, the first volume is configured to receive fluid leaked through the housing to into the first volume from the high fluid-pressure region of the channel, and the first port is coupled in fluid communication directly between the first volume of the first shaft chamber and the low fluid-pressure region of the channel. The second shaft chamber is defined by a sidewall extending between an end wall and a bearing rotatably connecting the drive shaft to the housing, the drive shaft is sealed to the sidewall of the second shaft chamber by a radial shaft seal within the second shaft chamber thereby dividing the second shaft chamber into a first volume between the end wall and the radial shaft seal and a second volume between the bearing and the radial shaft seal, the first volume is configured to receive fluid leaked through the housing to into the first volume from the high fluid-pressure region of the channel, and the second port is coupled in fluid communication directly between the first volume of the second shaft chamber and the low fluid-pressure region of the channel.

BRIEF DESCRIPTION OF THE DRAWINGS

Referring to the drawings.

DETAILED DESCRIPTION

Figure 1:
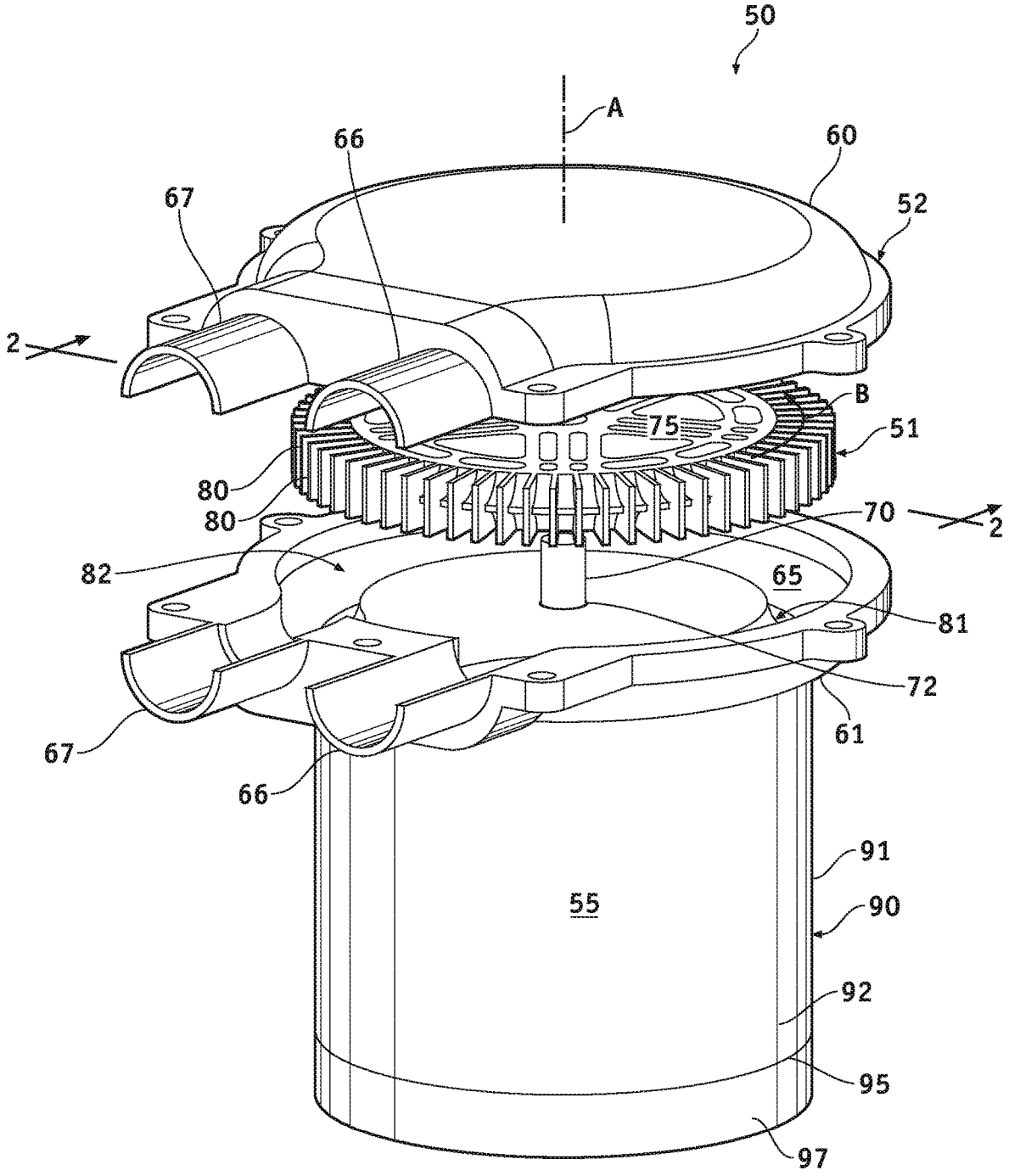
FIG. 1 is a partly exploded perspective view of a regenerative blower-compressor constructed and arranged in accordance with the principle of the invention, the regenerative blower-compressor including an impeller, and a housing including an upper part or cover and a lower part or base formed in a head of a housing can.

A regenerative blower-compressor includes an impeller mounted to a drive shaft within a housing including a channel extending from an inlet adjacent to a low fluid-pressure region of the channel to an outlet adjacent to a high fluid-pressure region of the channel. The drive shaft is mounted to the housing for rotation by rotary bearings. The low fluid-pressure region of the channel can simply be referred to as the low-pressure region of the channel, and the high fluid-pressure region of the channel can simply be referred to as the high-pressure region of the channel. The impeller extends radially outward through an annular volume within the housing from the drive shaft to blades in the channel. The impeller is configured to rotate for concurrently rotating the blades through the channel for forcing fluid through the channel from the inlet to the outlet in response to rotation of the drive shaft. The drive shaft extends from the impeller within the annular volume to into a shaft chamber within the housing, and the shaft chamber is inherently configured to receive, and be inherently pressurized by, leaked fluid, namely, the fluid that leaks through the housing to into the shaft chamber from the high-pressure region of the channel. The pressure in the channel continually increases from the inlet to the outlet due the regeneration action of the multiple blades rotating through the channel. As the pressure capability of the regenerative blower increases, proportionate pressure differentials between the high-pressure and low-pressure regions exist, in some cases only a few inches apart, without any firm physical barrier between them. The introduction of contact seals adds inherent cost and complication, decreases efficiency resulting from the inherent resulting friction, and introduces wear particles thereby defeating the inherent functional advantages of the regenerative blower.

It is an object of the invention to provide regenerative blowers configured to provide improved volumetric efficiency, to reduce loss of lubricant from the bearings connecting the shaft rotatably to the housing, and to stop or otherwise arrest the transfer of lubricant from the bearings into the process fluid stream. The regenerative blowers constructed and arranged in accordance with the invention capture the leaked fluid that leaks through the housing and which is normally lost and not put to a beneficial use and directly diverts it to the functional fluid path. By sending the leaked fluid to the low-pressure regions of the blower, the volumetric capacity of the blower is automatically increased and pressure acting on the bearing and seals is automatically relieved or otherwise eased. In some embodiments, the fluid from the high-pressure region of the channel is ported directly from the fluid flow path in the channel at the high-pressure region of the channel to the shaft chamber and directly from the shaft chamber to the fluid path in the channel at the low-pressure region of the channel. This is accomplished by ports, each of which can be a machined port, channel, drilled hole, cast in feature, hose, tube, or the like, in a singular location in certain embodiments and multiple locations in other embodiments. Again, the fluid captured and diverted to the low-pressure region of the channel automatically increases fluid flow through the channel and automatically relieves the pressure differential across the bearings and seals thereby arresting or at least reducing lubricant loss from the bearings.

Various embodiments of the invention are configured to use the circumferential pressure rise in a regenerative blower-compressor to tune the pressures in the vent ports to accomplish additional tasks in the blower-compressor, such as arresting or at least reducing high-pressure fluid leakage where the working fluid is flammable, dangerous, valuable, or similar circumstances where low to no leakage is desired. Additional functions can include accommodating different pressure needs of seals in and between two-stage regenerative blowers-compressors, and providing positive air pressure to ventilate motors and other incorporated components. Certain embodiments of the invention are also configured to operate at high pressures while overlapping the lower range of compressor systems.

For the balance of this disclosure, the term regenerative compressor and regenerative blower are used interchangeably. The interchangeability of these terms is well understood by skilled artisans. Moreover, it is known that regenerative machines are primarily used to move and compress gases, but are also used as liquid pumps in some cases. In this disclosure, the terms regenerative blower and regenerative compressor also apply to liquid pumps, even though the working fluid is an incompressible liquid. The same general advantages of this invention apply to them as well. Accordingly, the various embodiments of the invention are each referred to simply as regenerative blower-compressor.

Figure 2:
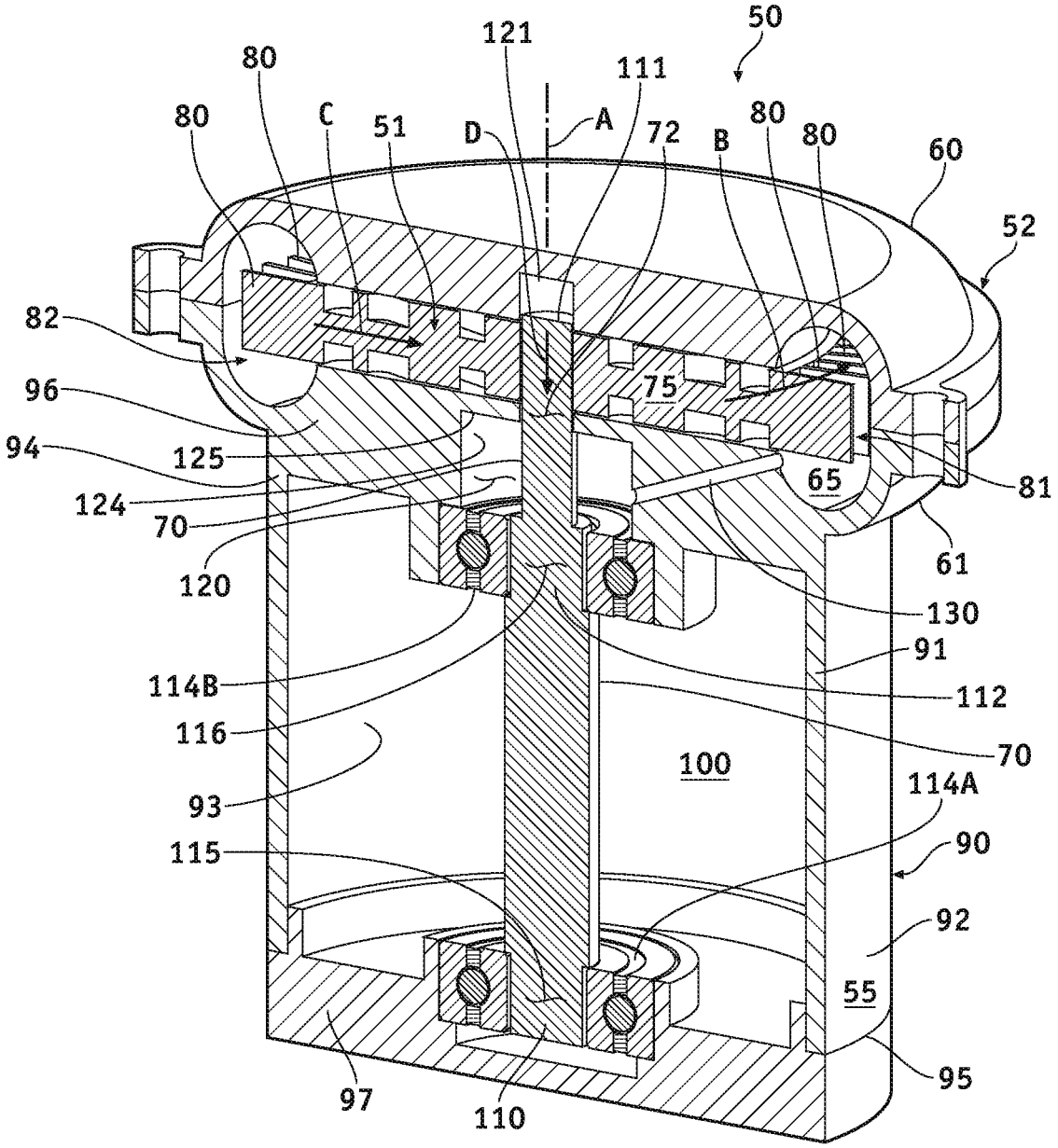
FIG. 2 is a vertical section view of the embodiment of FIG. 1 assembled taken along line 2-2 of FIG. 1.

Turning now to the drawings, in which like reference characters indicate corresponding elements throughout the several views, attention is directed in relevant part to FIG. 1 and FIG. 2, in which there is illustrated a regenerative blower-compressor 50 constructed and arranged in accordance with the principle of the invention including impeller 51 and housing 55. Housing 55 includes annular housing 52 and can 90. Annular housing 52 includes upper part or cover 60 and lower part, bottom, or base 61. Annular housing 52 surrounds impeller 51, and impeller 51 is rotatable within annular housing 52 about axis A of rotation, as is well-known in the art.

Annular housing 52 is an assembly of cover 60 and opposed base 61, which are connected together to surround impeller 51 and define the customary toroidal flow channel 65. Cover 60 and base 61 are rigidly affixed together with fasteners (not shown), such as nut-and-bolt fasteners, as is also well-known in the art. Annular housing 52 defines channel 65 for a fluid, such as a gaseous fluid, such as air or other gas, or a chosen liquid, inlet 66 to admit the fluid to channel 65, outlet 67 to discharge the fluid from channel 65, and annular volume 75 where impeller 51 resides, and this arrangement is also known in the art.

Impeller 51 is mounted directly on motor or drive shaft 70. Drive shaft 70 passes or otherwise extends from impeller 51 downwardly through hole 72 in the center of base 61 of annular housing 52 to into a shaft chamber of housing 55. Shaft 70 is arranged and rotates about axis A of rotation and is driven for rotation by an electric motor (not shown), which, in turn, imparts rotation to impeller 51 in the direction of arrow B for driving the fluid through channel 65 from inlet 66 to outlet 67. Shaft 70 is customarily mounted for rotation to housing 55 by internal rotary bearings described below. Shaft 70 rotates impeller 51 at a chosen speed, such as from about 2900-3500 revolutions per minute, which is a common and well-known range, and beyond the upper limit of this range to about 30,000 revolutions per minute is some embodiments depending on the capability of the motor. Impeller 11 has numerous conventional blades 40 formed on its circumference.

Impeller 11 extends radially outward through annular volume 75 within annular housing 52 of housing 55 from axis A of rotation and shaft 70 to numerous impeller blades 80 in channel 65. The number, size, and angle of blades 80 are chosen to define the pneumatic performance characteristics of blower-compressor 50. Impeller 51 spins or otherwise rotates about axis A of rotation within annular housing 52. As impeller 51 rotates, blades 80 rotate through channel 65 in the direction of arrow B, which forces the fluid through channel 65 from inlet 66 to outlet 67. The fluid is increasingly pressurized as it passes through channel 65 from inlet 66 to outlet 67, in which the fluid discharged through outlet 67 is at a higher relative pressure than that of the fluid entering channel 65 through inlet 66. The fluid pressure in channel 65 inherently increases gradually from inlet 66 to outlet 67. This is an inherent characteristic of regenerative blowers-compressors. The fluid thereby translates through channel 65 from a low fluid-pressure region 81 of channel 65 proximate to inlet 66 to a comparatively high fluid-pressure region 82 of channel 65 proximate to outlet 67.

The intake region of channel 65 near, or otherwise adjacent to, inlet 66 is low fluid-pressure region 81 of blower-compressor 50, and the discharge region of channel 65 near, or otherwise adjacent to, outlet 67 is high fluid-pressure region 82 of blower-compressor 50. As the fluid is forced through channel 65 from inlet 66 to outlet 67 via rotating impeller 51, the fluid is captured between each blade 80 on the circumference of impeller 51 and is pushed both outward and forward into channel 65 and then back to the base of each blade 80. This regeneration process is repeated over and over as impeller 51 spins. It is this regeneration that gives blower-compressor 50 its inherent pressure/vacuum capabilities. Blower-compressor 50 thereby operates like a staged reciprocal compressor and while each blade to blade regeneration stage results in slight pressure increases, such as from 1.2-1.4 pounds per square inch gauge (psig) the sum of the slight pressure increases through channel 65 from inlet 66 to outlet 67 can yield comparatively higher continuous operating pressures, such as approximately 3 psig.

Base 61 is carried by can 90. Referring to FIGS. 1 and 2 in relevant part, can 90 includes continuous sidewall 91 having outer surface 92, inner surface 93, upper edge 94, and lower edge 95. Horizontal top or head 96 is affixed to upper edge 94. Horizontal base or bottom 97 is affixed to lower edge 95. Continuous sidewall 91 extends upright from lower edge 95 affixed to bottom 97 to upper edge 94 affixed to head 96. Head 96 and bottom 97 cooperates with inner surface 93 30 to form enclosed volume 100 in FIG. 12 configured to accept an electric motor for imparting rotation to drive shaft 70. Base 61 is formed in, and is integral with, head 96. Head 96 can be considered a part or otherwise an extension of base 61. In an alternate embodiment, base 61 can be a separate part affixed to head 96 or to upper edge 94 of can 90 with fasteners or other chosen joinery.

In FIG. 2, drive shaft 70 is elongate, is arranged and rotates about axis A of rotation, and includes lower end 110 and opposed upper end 111. Lower end 110 of drive shaft 70 is mounted to bottom 97 of can 90 for rotation by bearing 114A fitted in socket 115 formed centrally in bottom 97. Intermediate part 112 of drive shaft 70 between its lower end 110 and upper end 111 is mounted to head 96 of can 90 for rotation by bearing 114B fitted in socket 116 formed centrally in head 96. Shaft 70 extends upright centrally through volume 100 from its lower end 110 mounted for rotation to bottom 97 by bearing 114B to its intermediate part 112 mounted for rotation to head 96 by bearing 114B, and with additional reference to FIG. 3 beyond bearing 114B through shaft chamber 120 formed in centrally head 96 on the underside of impeller 51 and to hole 72 formed centrally in head 96 and base 61 and beyond hole 72 centrally through and beyond impeller 51 to upper end 111 received and held by central recess 121 of cover 60 on the upper side of impeller 51. Shaft chamber 120 in FIGS. 2 and 3 is defined by sidewall 124 extending between end wall 125 and bearing 114B rotatably connecting intermediate part 112 of drive shaft 70 to head 96.

As described above, volume 110 is configured to accept and house an electric motor operatively connected to drive shaft 70 between bearings 114A and 114B, whereby actuation of the electric motor imparts corresponding rotation to drive shaft 70. Bearings 114A and 114B are identical and entirely conventional rotary bearings customarily lubricated with a chosen amount of a suitable lubricant, such as a customary chosen grease, a customary chosen oil, or both, sufficient to enable each of them to operate smoothly and orderly in accordance with standard operating parameters.

Figure 3:
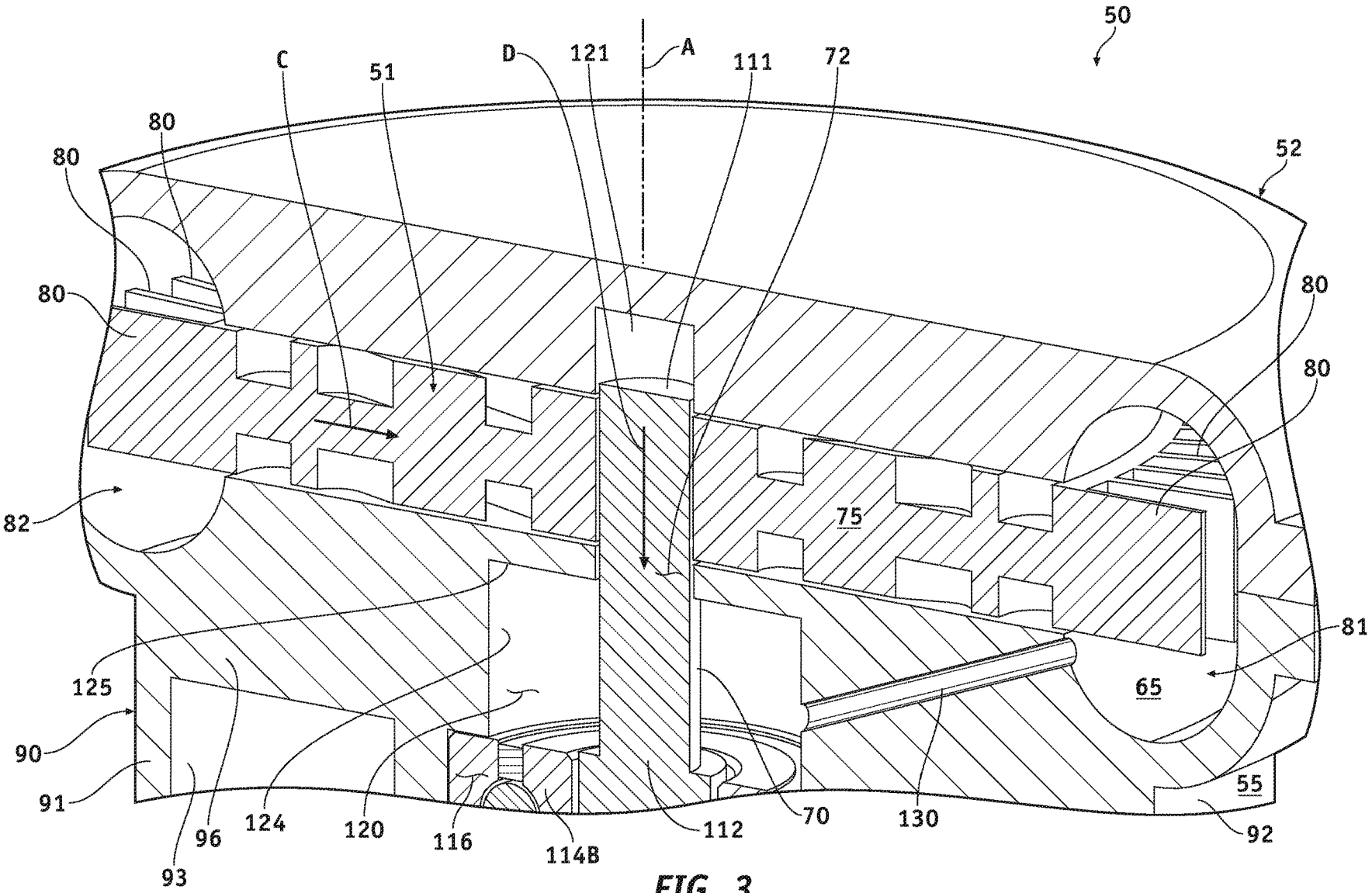
FIG. 3 is an enlarged fragmented perspective view corresponding to FIG. 2.

During operation of blower-compressor 50, fluid in channel 65 inherently constantly leaks through housing 55 through the inherent clearance between impeller 51 and annular volume 75 of housing 55 in the direction of arrow C in FIGS. 2 and 3 from high fluid-pressure region 82 of channel 65 toward low fluid-pressure region 81 of channel 65 to shaft 70, and downwardly in the direction of arrow D in FIGS. 2 and 3 through the inherent clearance between drive shaft 70 and hole 72 formed in base 61 and head 96 to into shaft chamber 120 thereby pressurizing shaft chamber 120 with the leaked fluid, termed herein as leaked or bypass fluid, from high fluid-pressure region 82. The constant fluid leakage direction of arrow C from high fluid-pressure region 82 toward low fluid-pressure region 81 is perpendicular relative to drive shaft 70 and axis A of rotation of impeller 11, and of arrow D is parallel relative to drive shaft 70 from volume 75 to shaft chamber 120. The inherent leaking of fluid from high fluid-pressure region 82 toward low fluid-pressure region 81 in the direction of arrow C and downwardly in the direction of arrow D to into shaft chamber 120 is a function of the pressure differential across the interior volume of housing 55 during blower-compressor 50 operations. Accordingly, shaft chamber 120 of blower-compressor 50 is inherently configured in blower-compressor 50 to constantly receive fluid that constantly leaks through housing 55 between impeller 51 and annular volume 75 and between drive shaft 70 and hole 72 through base 61 and head 96 to into shaft chamber 70 from high fluid-pressure region 82 of channel 65, and this is a known inherent characteristic of blower-compressor 50.

In short, blower-compressor 50 includes impeller 51 mounted to drive shaft 70 within housing 55 including channel 65 extending from inlet 66 adjacent to into low fluid-pressure region 81 of channel 65 to outlet 67 adjacent to comparatively high fluid-pressure region 82 of channel 65. Drive shaft 70 is mounted rotatably to housing 55. Impeller 51 extends radially outward through annular volume 75 within housing 55 from drive shaft 70 to blades 80 in channel 65. Impeller 51 is configured to rotate about axis A of rotation for rotating blades 80 through channel 65 for forcing fluid through channel 65 from inlet 66 to outlet 67 in response to rotation of drive shaft 70 about axis A of rotation. Drive shaft 70 extends from impeller 52 within annular volume 75 to into shaft chamber 120 within housing 55. Shaft chamber 120 is configured to constantly receive leaked fluid, i.e. the so-called bypass fluid that constantly leaks thereinto through housing 55 between impeller 51 and annular volume 75 and between drive shaft 70 and hole 72 through base 61 and head 96 from high fluid-pressure region 82 of channel 65. Blower-compressor 50 described thusly is generally representative of a conventional single-stage regenerative blower. With the exception of the improvements to blower-compressor 50 discussed in the various embodiments below, the further conventional details of blower-compressor 50 will readily occur to the skilled artisan and are not discussed.

According to the principle of the invention, blower-compressor 50 is constructed and arranged to constantly and directly return/supply the bypass fluid leaked through housing 55 from high fluid-pressure region 82 to into shaft chamber 120 to into low fluid-pressure region 81 of channel 65 from shaft chamber 120 and thereby into the functional fluid path through channel 65 at low fluid-pressure region 81 of channel 65. According to the invention denoted at 50, this is accomplished by port 130 in FIGS. 2 and 3.

Figure 4:
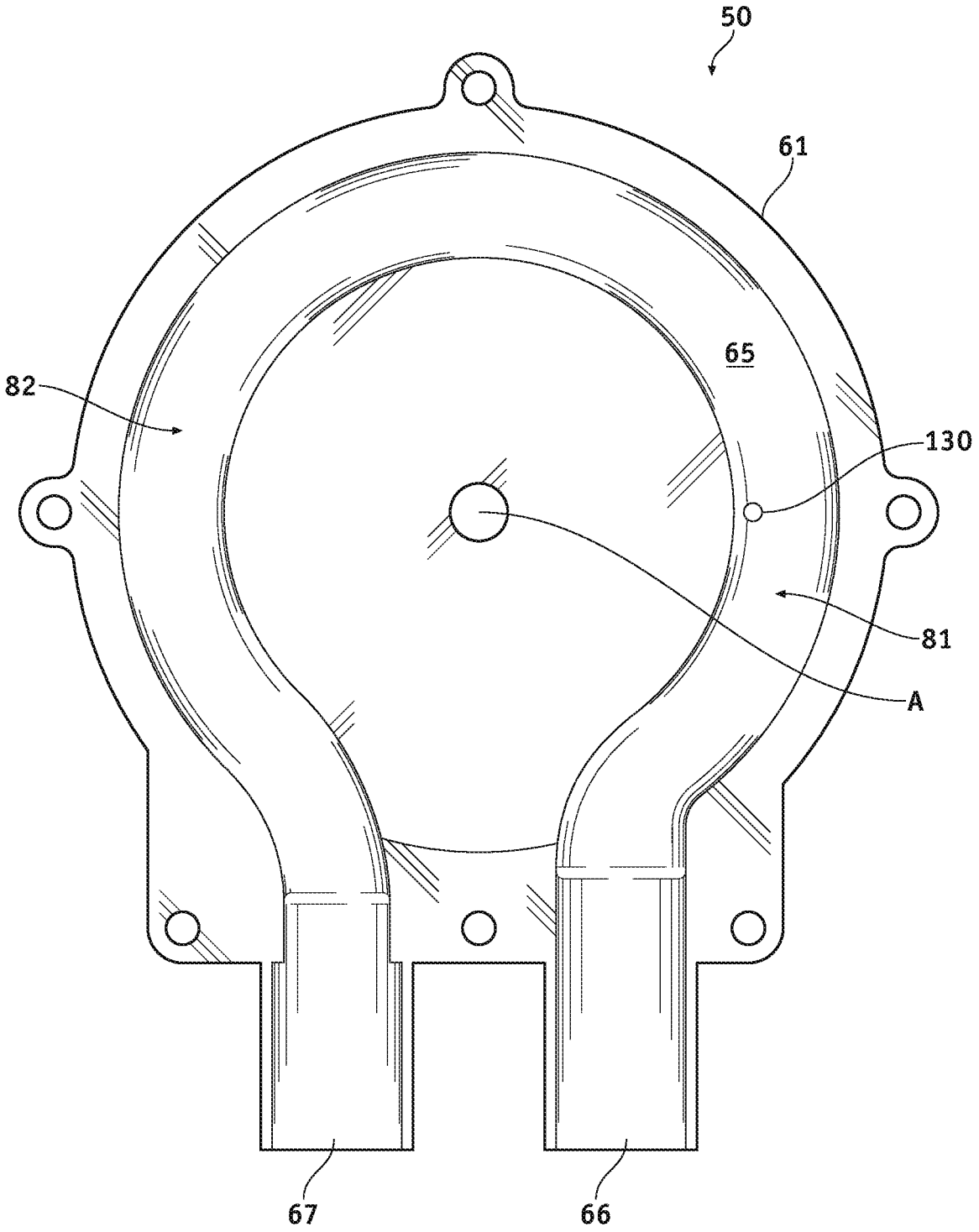
FIG. 4 is a top plan view of the base of FIG. 1.

Port 130 is operatively connected in fluid communication between shaft chamber 120 and low fluid-pressure region 81 of channel 65 to constantly receive fluid from shaft chamber 120 and constantly supply it to low fluid-pressure region 81 of channel 65, whereby fluid constantly leaked through housing 55 to into shaft chamber 120 from high fluid-pressure region 82 of channel 65 is constantly and directly returned by port 130 to into low fluid-pressure region 81 of channel 65 from shaft chamber 120 and thereby into the functional fluid path through channel 65 at low fluid-pressure region 81 of channel 65. Port 130 is a return port or return re-vent coupled directly in fluid communication between shaft chamber 120 and low fluid-pressure region 81 of channel 65 for independently, directly, and constantly returning/venting the fluid constantly leaked to into shaft chamber 120 from high fluid-pressure region 82 of channel from shaft chamber 120 to into low fluid-pressure region 81 of channel 65. In the embodiment of FIGS. 2 and 3, port 130 is formed directly through the material of head 96 and base 61, such as by drilling or machining or the like, from sidewall 124, between end wall 125 and bearing 114B, to base 61 at low fluid-pressure region 81 of channel 65, shown also in FIG. 4, on the underside of impeller 51 in FIGS. 2 and 3. This directly couples shaft chamber 120 to channel 65 at low fluid-pressure region 81 in fluid communication enabling low fluid-pressure region 81 of channel 65 to receive fluid from shaft chamber 120 via port 130.

During operation of blower-compressor 50, fluid in channel 65 constantly leaks through housing 55 between impeller 51 and annular volume 75 of housing 55 in the direction of arrow C in FIG. 2 from high fluid-pressure region 82 of channel 65 toward low fluid-pressure region 81 of channel 65 to shaft 70, and downwardly in the direction of arrow D between drive shaft 70 and hole 72 formed in base 61 and head 96 to into shaft chamber 120. Accordingly, shaft chamber 120 constantly receives the so-called bypass fluid, the fluid that constantly leaks from high fluid-pressure region 82 to into shaft chamber 120. Port 130 coupled directly in fluid communication between shaft chamber 120 and low fluid-pressure region 81 of channel 65 at base 61 of annular housing 52 independently, directly, and constantly vents the leaked fluid from shaft chamber 120 to into low fluid-pressure region 81 of channel 65 from base 61 and thereby to into the functional fluid flow through channel 65 at low fluid-pressure region 81 of channel 65. Accordingly, port 130 directly and constantly supplies/vents/ports the leaked fluid from shaft chamber 120 to into the fluid path of channel 65 through base 61 at low fluid-pressure region 81 of channel 65. This constant recirculation supply of the bypass fluid from shaft chamber 120 to into low fluid-pressure region 81 of channel 65 by port 130 inherently increases the fluid flow through channel 65 thereby inherently improving the volumetric efficiency and operation of blower-compressor 50, and at the same time constantly relieves the pressure in shaft chamber 120, which thereby arrests or at least reduces the pressure differential across bearing 114B at shaft chamber 120 to, in turn, thereby arrest or at least reduce lubricant loss from bearing 114B, according to the principle of the invention. Although blower-compressor 50 has one return port 130, it can be formed with two or more separate return ports 130 in alternate embodiments at to different locations between shaft chamber 120 and along low fluid-pressure region 81 of channel 65.

Figure 5:
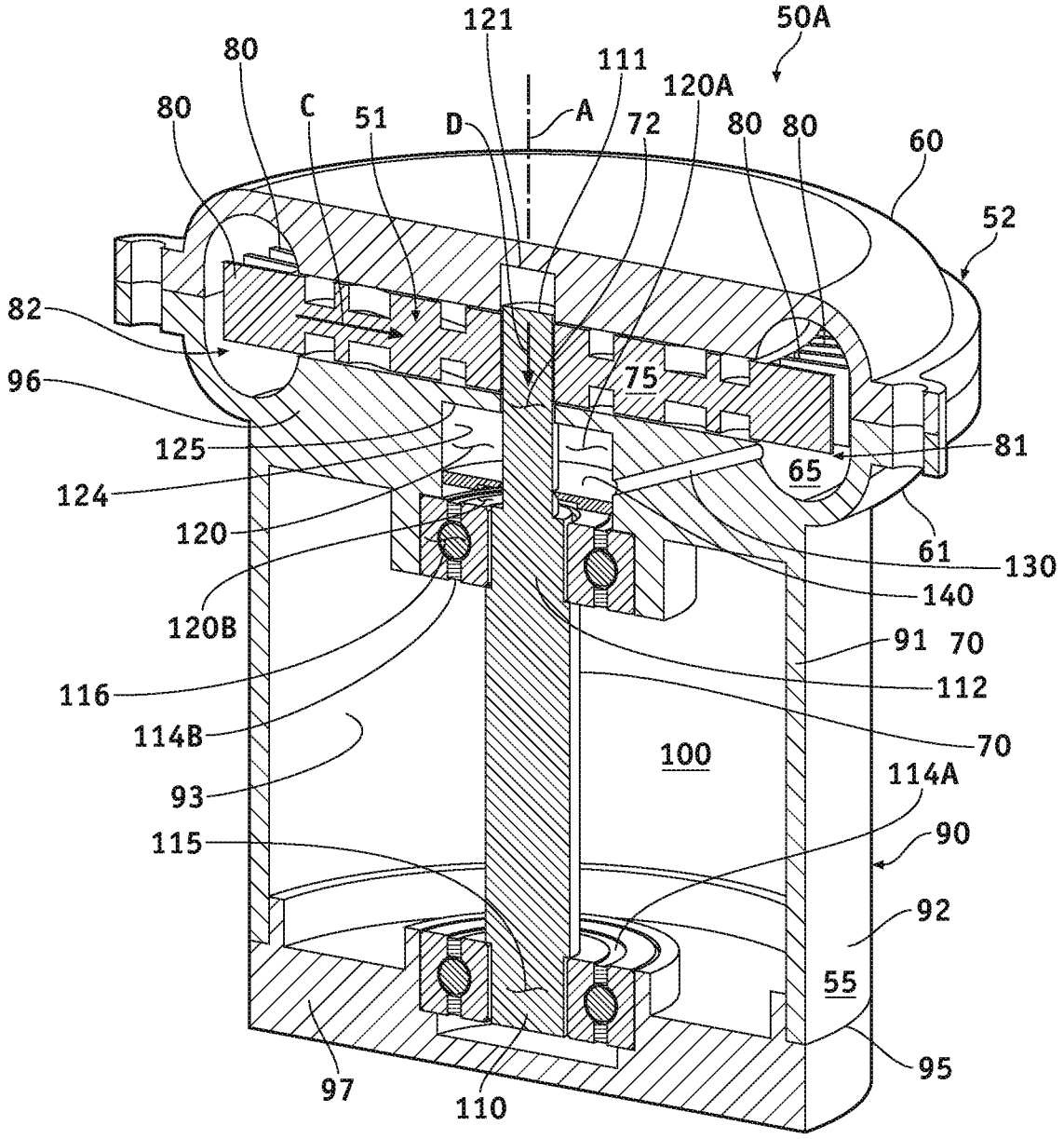
FIG. 5 is a view like the illustration of FIG. 2 showing an alternate embodiment of a regenerative blower-compressor constructed and arranged in accordance with the principle of the invention.
Figure 6:
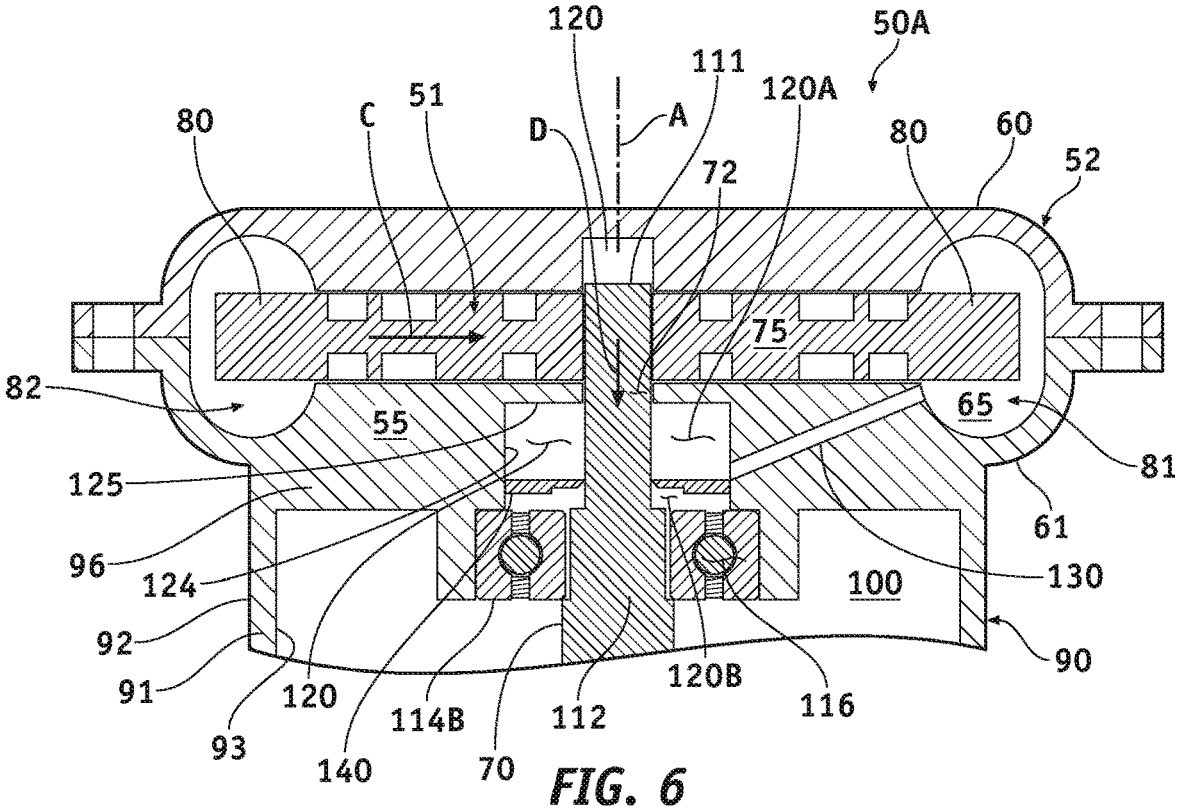
FIG. 6 is fragmented elevation view corresponding to FIG. 5.

In FIGS. 5 and 6, the previously described blower-compressor 50 is shown modified by radial shaft seal 140 thereby forming an alternate embodiment of a regenerative blower-compressor denoted at 50A. The reference numerals used in the description of blower-compressor 50 are also used where appropriate in the embodiment denoted at 50A.

In blower-compressor 50A, radial shaft seal 140 is within shaft chamber 120 of regenerative blower-compressor 50A between end wall 125 and bearing 114B, and is configured to seal drive shaft 70 to sidewall 124 between end wall 125 and bearing 114B thereby inherently dividing shaft chamber 120 into a first or upper volume 120A between end wall 125 and radial shaft seal 140 and a second or lower volume 120B between bearing 114B and radial shaft seal 140. First and second volumes 120A and 120B are on either side of radial shaft seal 140. First volume 120A is on the upper side of radial shaft seal 140, and second volume 120B is on the opposite lower side of radial shaft seal 140. Radial shaft seal 140 seals first volume 120A from second volume 120B, and thereby from bearing 114B at second volume 120B. In this embodiment, first volume 120A is greater than second volume 120B, and port 130 is coupled directly in fluid communication between first volume 120A of shaft chamber 120, at sidewall 124 between radial shaft seal 140 and bearing 114B, and low fluid-pressure region 81 of channel 65 at base 61 thereby enabling low fluid-pressure region 81 of channel 65 to receive bypass fluid from first volume 120A of shaft chamber 120.

Blower-compressor 50A is constructed and arranged to constantly and directly return/supply leaked fluid, i.e. the so-called bypass fluid that constantly leaks from high fluid-pressure region 82 through housing 55 to into first volume 120A of shaft chamber 120 from first volume 120A of shaft chamber 120 to into low fluid-pressure region 81 of channel 65 and thereby into the functional fluid path through channel 65 at low fluid-pressure region 81. This is accomplished in blower-compressor 50A by the previously-described port 130.

Port 130 is operatively connected in fluid communication between first volume 120A of shaft chamber 120 and low fluid-pressure region 81 of channel 65 to constantly receive fluid from first volume 120A of shaft chamber 120 and constantly supply it to low fluid-pressure region 81 of channel 65, whereby fluid constantly leaked to into first volume 120A of shaft chamber 120 from high fluid-pressure region 82 of channel 65 is constantly returned by port 130 to into low fluid-pressure region 81 of channel 65 from first volume 120A and thereby into the functional fluid path through channel 65 at low fluid-pressure region 81 of channel 65. Port 130 is a return port or return re-vent coupled directly in fluid communication between first volume 120A of shaft chamber 120 and low fluid-pressure region 81 of channel 65 for independently, directly, and constantly returning/venting fluid constantly leaked to into first volume 120A of shaft chamber 120 from high fluid-pressure region 82 from first volume 120A of shaft chamber 120 to into low fluid-pressure region 81 of channel 65. Port 130 is coupled in fluid communication directly between first volume 120A of shaft chamber 120, at sidewall 124 between end wall 125 and radial shaft seal 130, and low fluid-pressure region 81 of channel 65 at base of annular housing 52 at the underside of impeller 51. This directly couples first volume 120A of shaft chamber 120 to channel 65 at low fluid-pressure region 81 in fluid communication enabling low fluid-pressure region 81 of channel 65 to receive fluid from first volume 120A of shaft chamber 120 via port 130.

During operation of blower-compressor 50A, fluid in channel 65 constantly leaks through housing 55 through the inherent clearance between impeller 51 and annular volume 75 of housing 55 in the direction of arrow C in FIGS. 5 and 6 from high fluid-pressure region 82 of channel 65 toward low fluid-pressure region 81 of channel 65 to shaft 70, and downwardly in the direction of arrow D through the inherent clearance between drive shaft 70 and hole 72 formed in head 96 to into first volume 120A of shaft chamber 120. Accordingly, first volume 120A constantly receives the so-called bypass fluid, the fluid that constantly leaks from high fluid-pressure region 82 to into first volume 120A. Port 130 coupled directly in fluid communication between first volume 120A of shaft chamber 120 and low fluid-pressure region 81 of channel 65 at base 61 of annular housing 52 independently, directly, and constantly supplies/vents/ports the leaked fluid from first volume 120A of shaft chamber 120 to into low fluid-pressure region 81 of channel 65 from base 61 and thereby to into the functional fluid flow through channel 65 at low fluid-pressure region 81 of channel 65. Accordingly, port 130 constantly and directly supplies/vents/ports the bypass fluid directly and independently from first volume 120A of shaft chamber 120 to into the fluid path of channel 65 through base 61 at low fluid-pressure region 81 of channel 65. This constant recirculation supply of the bypass fluid from first volume 120A shaft chamber 120 to into low fluid-pressure region 81 of channel 65 advantageously increases the fluid flow through channel 65 thereby inherently improving the volumetric efficiency and operation of blower-compressor 50A as described above in connection with blower-compressor 50, and at the same time constantly relieves the pressure in first volume 120A of shaft chamber 120, which thereby arrests or at least reduces the pressure differential across radial shaft seal 140. This arrests or at least reduces lubricant loss from bearing 114B, and reduces the stress across radial shaft seal 140, thereby inherently improving the useful functional life of radial shaft seal 140, and across bearing 114B at second volume 120B of shaft chamber 120 to, in turn, thereby arrest or at least reduce lubricant loss from bearing 114B, according to the principle of the invention. Although blower-compressor 50A has one return port 130, it can be formed with two or more separate return ports 130 in alternate embodiments at different locations between shaft chamber 120 and along low fluid-pressure region 81 of channel 65.

Figure 7:
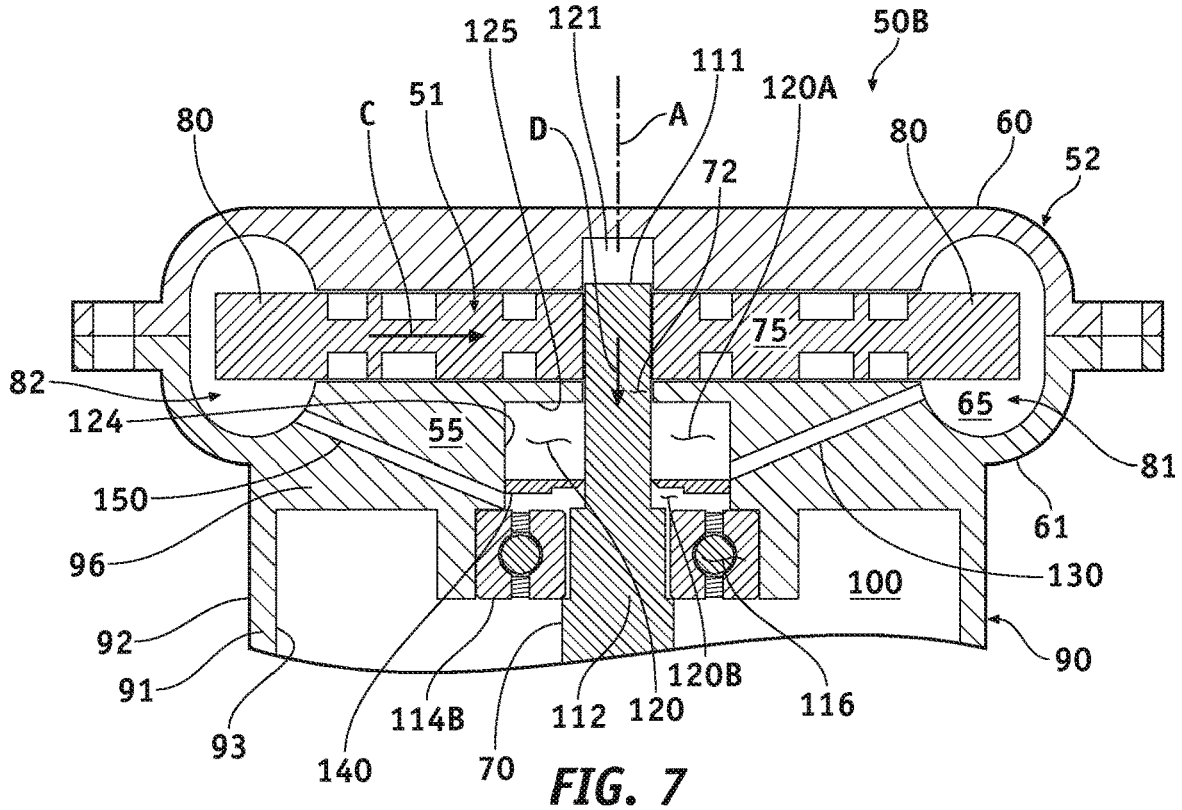
FIG. 7 is a view like the illustration of FIG. 5 illustrating another embodiment of a regenerative blower-compressor constructed and arranged in accordance with the principle of the invention.

In FIG. 7, the previously described blower-compressor 50A is modified by port 150 thereby forming an alternate embodiment of a regenerative blower-compressor denoted at 50B. The reference numerals used in the description of blower-compressor 50A are also used where appropriate in the embodiment denoted at 50B.

Blower-compressor 50B is constructed and arranged to constantly and directly supply fluid directly from high fluid-pressure region 82 of channel 65 to into second volume 120B of shaft chamber 120. This is accomplished in blower-compressor 50B by port 150, which is operatively connected in fluid communication directly between high fluid-pressure region 82 of channel 65 and second volume 120B of shaft chamber 120. At the same time, blower-compressor 50B is constructed and arranged to constantly and directly return/supply leaked fluid, i.e. the so-called bypass fluid that constantly leaks from high fluid-pressure region 82 through housing 55 to into first volume 120A of shaft chamber 120 from first volume 120A of shaft chamber 120 to into low fluid-pressure region 81 of channel and thereby into the functional fluid path through channel 65 at low fluid-pressure region 81. This is accomplished in blower-compressor 50B by the previously-described port 130.

Port 150 is a supply port or re-vent operatively connected in fluid communication directly between second volume 120B of shaft chamber 120 and high fluid-pressure region 82 of channel 65 to constantly receive fluid from high fluid-pressure region 82 of channel and constantly supply it to second volume 120B, whereby fluid from high fluid-pressure region 82 of channel 65 is constantly supplied by port 150 to into second volume 120B. Port 150 is coupled in fluid communication directly between second volume 120B of shaft chamber 120, at sidewall 124 between rotary shaft seal 140 and bearing 114A, and high fluid-pressure region 82 of channel 65 at base 61 of annular housing 52 at the underside of impeller 51. Port 150 is formed directly through the material of head 96, such as by drilling or machining or the like, from sidewall 124, between radial shaft seal and bearing 114B, to base 61 at high fluid-pressure region 82 of channel 65 shown also in FIG. 8, which is a top plan view of base 61. This directly couples shaft chamber 120 to channel 65 at high fluid-pressure region 82 in fluid communication enabling shaft chamber 120 to receive fluid from high fluid-pressure region 82 of channel 65.

During operation of regenerative blower-compressor 50B as described above in blower-compressor 50A, fluid in channel 65 constantly leaks through housing 55 through the clearance between impeller 51 and annular volume 75 of housing 55 in the direction of arrow C in FIG. 7 from high fluid-pressure region 82 of channel 65 toward low fluid-pressure region 81 of channel 65 to shaft 70, and downwardly in the direction of arrow D through the clearance between drive shaft 70 and hole 72 formed in head 96 to into first volume 120A of shaft chamber 120 on the upper side of radial shaft seal 140. Accordingly, first volume 120A of shaft chamber 120 constantly receives the so-called bypass fluid, the fluid that constantly leaks from high fluid-pressure region 82 to into first volume 120A of shaft chamber 120. At the same time, port 150 coupled directly between second volume 120B of shaft chamber 120, at sidewall 124 between radial shaft seal 130 and bearing 114B, and high fluid-pressure region 82 of channel 65 at base 61 of annular housing 52, independently, directly, and constantly supplies/ports/vents fluid from high fluid-pressure region 82 of channel 65 to into second volume 120B of shaft chamber 120 on the lower side of radial shaft seal 140. The constant supply of first volume 120A with bypass fluid leaked to into first volume 120A of shaft chamber 120 through housing 55 from high fluid-pressure region 82 of channel 65 and the concurrent constant supply of second volume 120B with fluid supplied directly to into second volume 120B of shaft chamber 120 from high fluid-pressure region 82 of channel 65 by port 150 inherently equalizes the pressure on either side of, or otherwise across, radial shaft seal 140.

Port 130 coupled directly in fluid communication between first volume 120A of shaft chamber 120 and low fluid-pressure region 81 of channel 65 at base 61 of annular housing 52 independently, directly, and constantly supplies/vents the leaked fluid from first volume 120A of shaft chamber 120 to into low fluid-pressure region 81 of channel 65 from base 61 and thereby to into the functional fluid flow through channel 65. Accordingly, port 130 constantly supplies/vents/ports the bypass fluid directly and independently from first volume 120A of shaft chamber 120 to into the fluid path of channel 65 through base 61 at low fluid-pressure region 81 of channel 65. This constant recirculation supply of the bypass fluid from first volume 120A shaft chamber 120 to into low fluid-pressure region 81 of channel 65 advantageously increases the fluid flow through channel 65 thereby inherently improving the volumetric efficiency and operation of blower-compressor 50B as described above in connection with blower-compressor 50A, and at the same time constantly relieves the pressure in first volume 120A of shaft chamber 120. While the pressure in first volume 120A is continuously relieved and first and second volumes 120A and 120B are continually supplied with fluid from high fluid-pressure region 82, first volume 120A by fluid leaked to into first volume 120A through housing 55 from high fluid-pressure region 82 and second volume 120B by fluid supplied directly to into second volume 120B from high fluid-pressure region 82 by port 150, the pressures in first volume 120A and second volume 120B equalize across radial shaft seal 140, which thereby arrests or at least reduces pressure differentials across radial shaft seal 140 or otherwise on either side of radial shaft seal. This arrests or at least reduces lubricant loss from bearing 114B, and reduces the stress across radial shaft seal 140, thereby inherently improving the useful functional life of radial shaft seal 140, and across bearing 114B at second volume 120B of shaft chamber 120 to, in turn, thereby arrest or at least reduce lubricant loss from bearing 114B, according to the principle of the invention.

Although blower-compressor 50B has one supply port 150, it can be formed with two or more separate supply ports 130 in alternate embodiments at different locations between shaft chamber 120 and along high fluid-pressure region 82 of channel 65. Although blower-compressor 50B has one return port 130, it can be formed with two or more separate return ports 130 in alternate embodiments at different locations between shaft chamber 120 and along low fluid-pressure region 81 of channel 65.

Figure 9:
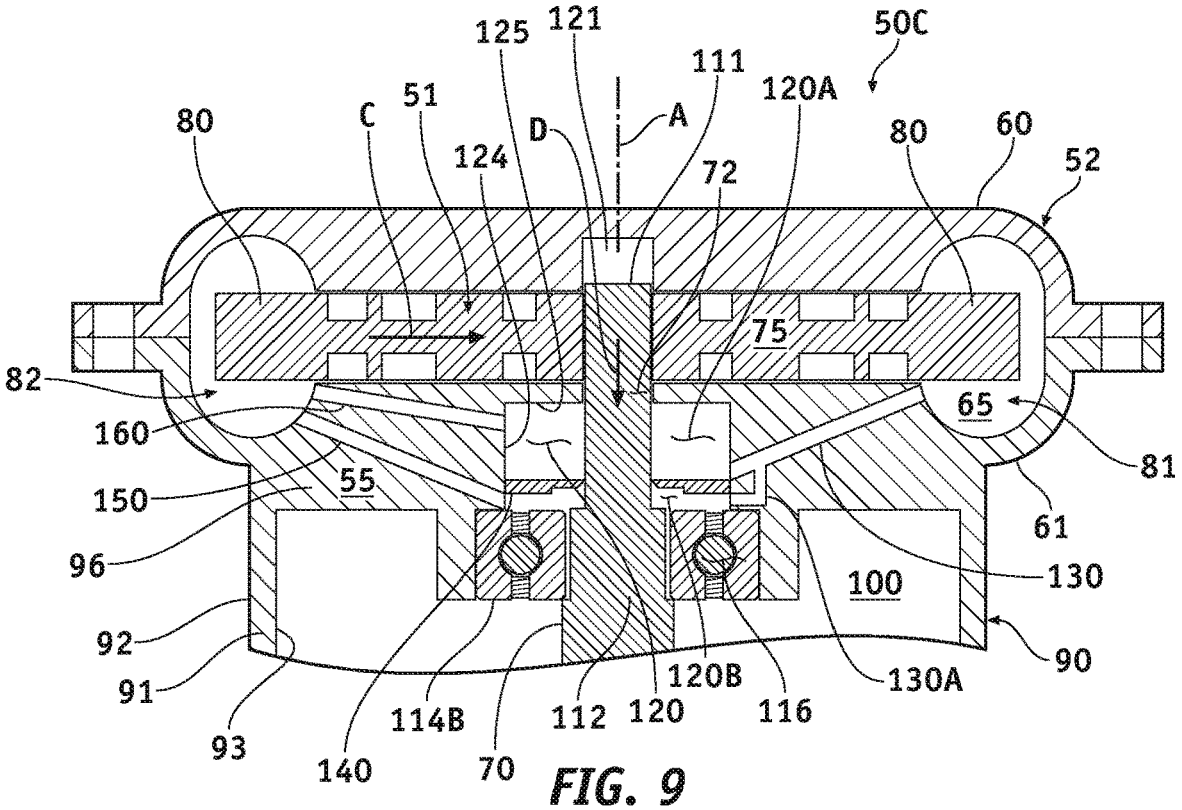
FIG. 9 is a view like the illustration of FIG. 6 illustrating yet another embodiment of a regenerative blower-compressor constructed and arranged in accordance with the principle of the invention.

In FIG. 9, the previously described blower-compressor 50B is modified by port 160 and by a modification to port 130 thereby forming an alternate embodiment of a regenerative blower-compressor denoted at 50C. The reference numerals used in the description of blower-compressor 50B are also used where appropriate in the embodiment denoted at 50B.

Blower-compressor 50C is constructed and arranged to constantly and directly supply fluid directly from high fluid-pressure region 82 of channel 65 to into first volume 120A of shaft chamber 120 and to into second volume 120B of shaft chamber 120. This is accomplished in blower-compressor 50C by port 160, which is operatively connected in fluid communication between high fluid-pressure region 82 of channel and first volume 120A of shaft chamber 120, and by the previously-described port 150, which is operatively connected in fluid communication between high fluid-pressure region 82 of channel 65 and second volume 120B of shaft chamber 120. At the same time, blower-compressor 50C is constructed and arranged to constantly and directly return/supply the fluid supplied to into second volume 120B from high fluid-pressure region 82 of channel 65 by port 150 from second volume 120B to into low fluid-pressure region 81 of channel 65 and thereby into the functional fluid path through channel 65 at low fluid-pressure region 81, and to constantly and directly return/supply the fluid supplied to into first volume 120A from high fluid-pressure region 82 of channel 65 by port 160 in addition to the leaked fluid, i.e. the so-called bypass fluid that constantly leaks from high fluid-pressure region 82 through housing 55 to into first volume 120A of shaft chamber 120 from first volume 120A of shaft chamber 120 to into low fluid-pressure region 81 of channel and thereby into the functional fluid path through channel 65 at low fluid-pressure region 81. This is accomplished in blower-compressor 50C by port 130 that is modified in blower-compressor 50C by being operatively connected in fluid communication between low fluid-pressure region 81 of channel 65 and both first volume 120A and second volume 120B of shaft chamber 120.

In regenerative blower-compressor 50C, port 130 is formed directly through the material of head 96, from sidewall 124, between end wall 125 and radial shaft seal 140, and base 61 at low fluid-pressure region 81 of channel 65, which thereby couples first volume 120A of shaft chamber 120 to channel 65 at low fluid-pressure region 81 in fluid communication. Port 130 is additionally configured with branch 130A, which operatively couples second volume 120B in fluid communication with port 130 and, thereby low fluid-pressure region 81 of channel 65. In this embodiment, branch 130A extends through the material of head 96 from second volume 120B at sidewall 124 between radial shaft seal 140 and bearing 114B to port 130 between sidewall 124 of shaft chamber 120 and channel 65.

Figure 8:
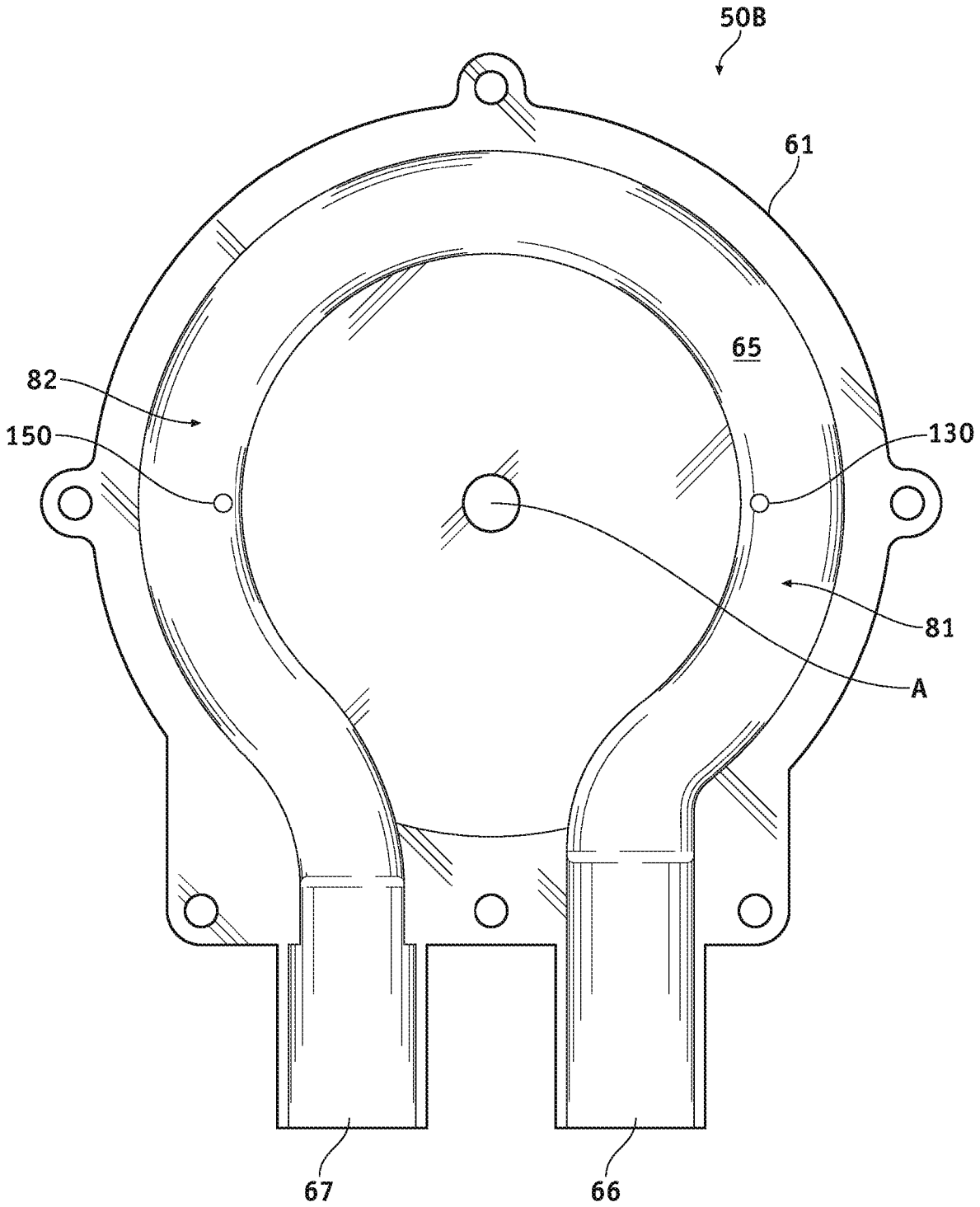
FIG. 8 is a top plan view of the base of the embodiment of FIG. 7.

Port 160 is a supply port or re-vent operatively connected in fluid communication directly between first volume 120A of shaft chamber 120 and high fluid-pressure region 82 of channel 65 to constantly receive fluid from high fluid-pressure region 82 and constantly supply it to first volume 120A of shaft chamber 120, whereby fluid from high fluid-pressure region 82 of channel 65 is constantly supplied by port 160 to into first volume 120A thereby bypassing the bypass fluid leak pathway through housing 55 defined by arrows C and D. As shown in FIG. 8, port 160 is formed directly through the material of head 96, such as by machining or drilling or the like, from base 61 at the underside of impeller 51 at high fluid-pressure region 82 of channel 65 to sidewall 124 between end wall 125 and radial shaft seal 140. Port 160 directly couples first volume 120A of shaft chamber 120 to channel 65 at high fluid-pressure region 82 in fluid communication enabling first volume 120A of shaft chamber 120 to receive fluid from high fluid-pressure region 82 of channel 65.

During operation of regenerative blower-compressor 50C, fluid in channel 65 constantly leaks through housing 55 through the clearance between impeller 51 and annular volume 75 of housing 55 in the direction of arrow C in FIG. 7 from high fluid-pressure region 82 of channel 65 toward low fluid-pressure region 81 of channel 65 to shaft 70, and downwardly in the direction of arrow D through the clearance between drive shaft 70 and hole 72 formed in head 96 to into first volume 120A of shaft chamber 120 thereby inherently constantly supplying first volume 120A of shaft chamber 120 on the upper side of radial shaft seal 140 with the leaked fluid, i.e. the bypass fluid that constantly leaks from high fluid-pressure region 82 to into first volume 120A of shaft chamber 120. Accordingly, first volume 120A of shaft chamber 120 constantly receives the so-called bypass fluid, the fluid that constantly leaks from high fluid-pressure region 82 to into shaft chamber 120. At the same time, port 160 coupled directly between first volume 120A of shaft chamber 120, at sidewall 124 between radial shaft seal 130 and end wall 125, and high fluid-pressure region 82 of channel 65 at base 61 of annular housing 52, independently, directly, and constantly supplies/ports/vents fluid from high fluid-pressure region 82 of channel 65 to into first volume 120A of shaft chamber 120. First volume 120A of shaft chamber 120 on the upper side of radial shaft seal 140 thereby constantly receives fluid from high fluid-pressure region 82 by port 160. Accordingly, first volume 120A constantly receives fluid from high fluid-pressure region 82 that constantly leaks into first volume 120A through housing 55 from high fluid-pressure region 82 of channel 65 and that is constantly supplied/ported/vented directly into first volume 120A from high fluid-pressure region 82 of channel 65 by port 160. Also at the same time, port 150 coupled directly between second volume 120B of shaft chamber 120, at sidewall 124 between radial shaft seal 130 and bearing 114B, and high fluid-pressure region 82 of channel 65 at base 61 of annular housing 52, independently, directly, and constantly supplies/ports/vents fluid from high fluid-pressure region 82 of channel 65 to into second volume 120B of shaft chamber 120 on the lower side of radial shaft seal 140. This concurrent application of fluid from high fluid-pressure region 82 of channel to into first volume 120A and to into second volume 120B equalizes the pressure on either side of, or otherwise across, radial shaft seal 140.

Port 130 coupled directly in fluid communication between low fluid-pressure region 81 of channel 65 at base 61 of annular housing 52 and first and second volumes 120A and 120B of shaft chamber 120 independently, directly, and constantly concurrently supplies/vents the fluid from first and second volumes 120A and 120B of shaft chamber 120 to into low fluid-pressure region 81 of channel 65 from base 61 and thereby to into the functional fluid flow through channel 65. Accordingly, port 130 constantly, concurrently, and directly supplies/vents/ports the fluid directly and independently from first and second volumes 120A and 120B of shaft chamber 120 to into the fluid path of channel 65 through base 61 at low fluid-pressure region 81 of channel 65. This constant concurrent recirculation of the fluid from first and second volumes 120A and 120B to into low fluid-pressure region 81 of channel 65 advantageously increases the fluid flow through channel 65 thereby inherently improving the efficiency and operation of blower-compressor 50C, and at the same time constantly and concurrently relieves the respective pressures in first and second volumes 120A and 120B of shaft chamber 120. While the pressures in first and second volumes 120A and 120B are continuously relieved by port 130 and first and second volumes 120A and 120B continually receive fluid from high fluid-pressure region 82 at the same time, first volume 120A by fluid supplied thereinto by port 160 and leaked thereinto through housing 55 from high fluid-pressure region 82, and second volume 120B by fluid supplied directly thereinto from high fluid-pressure region 82 by port 150, the pressures in first volume 120A and second volume 120B equalize across radial shaft seal 140, which thereby arrests or at least reduces pressure differentials across radial shaft seal 140 or otherwise on either side of radial shaft seal. This arrests or at least reduces lubricant loss from bearing 114B, and reduces the stress across radial shaft seal 140, thereby inherently improving the useful functional life of radial shaft seal 140. Although blower-compressor 50C has two supply ports 150 and 160, it can be formed with more in alternate embodiments at different locations between shaft chamber 120 and along high fluid-pressure region 82 of channel 65. Although blower-compressor 50C has one return port 130, it can be formed with two or more separate return ports 130 in alternate embodiments at different locations between shaft chamber 120 and along low fluid-pressure region 81 of channel 65.

Figure 10:
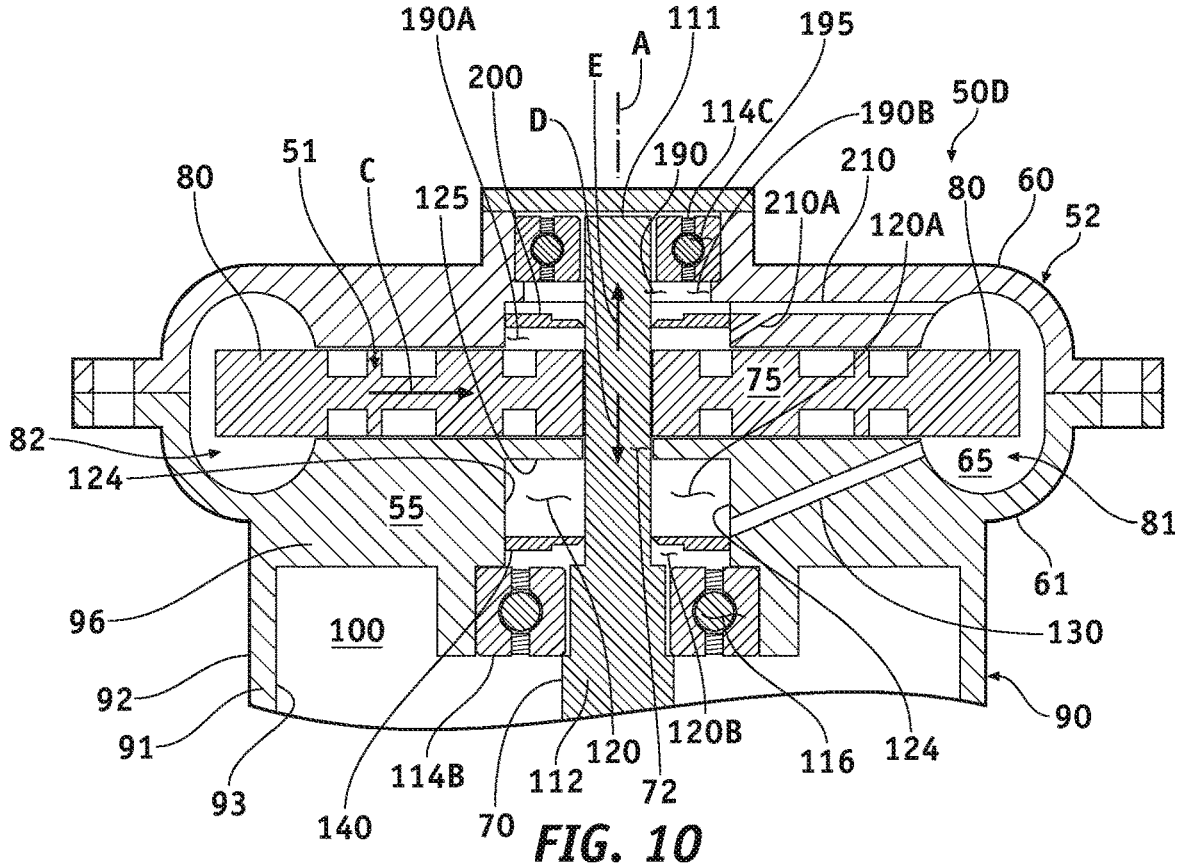
FIG. 10 is a view like the illustrations of FIGS. 5, 7, and 9 illustrating still another embodiment of a regenerative blower-compressor constructed and arranged in accordance with the principle of the invention.

In FIG. 10, the previously described blower-compressor 50A is modified by shaft chamber 190, bearing 114C, radial shaft seal 200, and port 210, thereby forming an alternate embodiment of a regenerative blower-compressor denoted at 50D. The reference numerals used in the description of blower-compressor 50A are also used where appropriate in the embodiment denoted at 50D.

Like blower-compressor 50A, intermediate part 112 of drive shaft 70 is mounted to head 96 of can 90 for rotation by bearing 114B fitted in socket 116 formed centrally in head 96, and shaft 70 extends upright beyond bearing 114B through shaft chamber 120 formed in centrally head 96 on the lower side of impeller 51 to hole 72 formed centrally in head 96 and beyond hole 72 centrally through impeller 51. In blower-compressor 50D, shaft 70 extends upright beyond impeller 51 through shaft chamber 190 formed centrally in cover 60 on the upper side of impeller 51 to upper end 111 mounted to cover 60 of annular housing 52 for rotation by bearing 114C fitted in socket 195 formed centrally in cover 60. Like bearings 114A and 114B, bearing 114C is an identical and entirely conventional rotary bearing lubricated with a chosen amount of a lubricant, such as a chosen grease, a chosen oil, or both, sufficient to enable bearing 114C to operate smoothly and orderly in accordance with standard operating parameters. Shaft chamber 190 is defined by sidewall 191 extending between impeller 51 and bearing 114C rotatably connecting upper end 111 of drive shaft 70 to cover 60.

Radial shaft seal 200 is within shaft chamber 190 of regenerative blower-compressor 50D between impeller 51 and bearing 114C, and seals drive shaft 70 to sidewall 191 between end impeller 51 and bearing 114C thereby inherently dividing shaft chamber 190 into a first or lower volume 190A between impeller 51 and radial shaft seal 200, and a second or upper volume 190B between radial shaft seal 200 and bearing 114C. First and second volumes 190A and 190B are on either side of radial shaft seal 200, in which first volume 190A is on the lower side of radial shaft seal 200 and second volume 190B is on the opposite upper side of radial shaft seal 200. Radial shaft seal 200 seals first volume 190A from second volume 190B, and thereby from bearing 114C at second volume 190B. In this embodiment, first volume 190A is greater than second volume 190B.

During operation of blower-compressor 50D, fluid in channel 65 inherently constantly leaks through housing 55 through the inherent clearance between impeller 51 and annular volume 75 of housing 55 in the direction of arrow C from high fluid-pressure region 82 of channel 65 toward low fluid-pressure region 81 of channel 65 to shaft 70, downwardly in the direction of arrow D through the inherent clearance between drive shaft 70 and hole 72 formed in head 96 to into first volume 120A of shaft chamber 120, and also upwardly in the direction of arrow E through the inherent clearance between annular volume 75 and impeller 51 to into first volume 190A of shaft chamber 190. Accordingly, first volume 120A of shaft chamber 120 constantly receives the so-called bypass fluid, the fluid that constantly leaks from high fluid-pressure region 82 to into first volume 120A of shaft chamber 120. Additionally, first volume 190A of shaft chamber constantly receives the so-called bypass fluid, the fluid that constantly leaks from high fluid-pressure region 82 to into first volume 190A of shaft chamber 190, and also second volume 190B of shaft chamber 190 when fluid blows by radial shaft seal 200 into second volume 190B from first volume 190A. The constant fluid leakage direction of arrow C is perpendicular relative to drive shaft 70 and axis A of rotation of impeller 11 from high fluid-pressure region 82, toward low fluid-pressure region 81, and of arrows D and E is parallel relative to drive shaft 70 from volume 75 to shaft chamber 120. The inherent leaking of fluid from high fluid-pressure region 82 toward low fluid-pressure region 81 in the direction of arrow C and downwardly in the direction of arrow D downwardly to into shaft chamber 120 and in the direction of arrow E upwardly to into first volume 190A and second volume 190B of shaft chamber 190 is a function of the pressure differential across the interior volume of housing 55 during blower-compressor 50D operations. Accordingly, shaft chambers 120 and 190 of blower-compressor 50D are each inherently configured to constantly receive leaked fluid that constantly leaks through housing 55 to into shaft chambers 120 and 190 from high fluid-pressure region 82 of channel 65.

Blower-compressor 50D is constructed and arranged to constantly and directly return the bypass fluid leaked to into first volume 120A of shaft chamber 120 through housing 55 from high fluid-pressure region 82 to into low fluid-pressure region 81 of channel 65 and thereby into the functional fluid path through channel 65 at low fluid-pressure region 81 of channel 65. This is accomplished by the previously-described port 130 of the embodiment denoted at 50A. At the same time, blower-compressor 50D is also constructed and arranged to constantly and directly return the bypass fluid leaked to into shaft chamber 190 through housing 55 from high fluid-pressure region 82 to into low fluid-pressure region 81 of channel 65 and thereby into the functional fluid path through channel 65 at low fluid-pressure region 81 of channel 65. This is accomplished by port 210 in blower-compressor 50D.

As described above in the embodiment denoted at 50A, port 130 is operatively connected in fluid communication between first volume 120A of shaft chamber 120 and low fluid-pressure region 81 of channel 65 to constantly receive fluid from first volume 120A of shaft chamber 120 and constantly supply it to low fluid-pressure region 81 of channel 65, whereby fluid constantly leaked to into first volume 120A of shaft chamber 120 from high fluid-pressure region 82 of channel 65 is constantly and directly returned by port 130 to into low fluid-pressure region 81 of channel 65 and thereby into the functional fluid path through channel 65 at low fluid-pressure region 81 of channel 65. Port 130 is a return port or return re-vent coupled directly in fluid communication between first volume 120A of shaft chamber 120 and low fluid-pressure region 81 of channel 65 for independently, directly, and constantly returning/venting fluid constantly leaked to into first volume 120A of shaft chamber 120 from high fluid-pressure region 82 from first volume 120A of shaft chamber 120 to into low fluid-pressure region 81 of channel 65. Port 130 is coupled in fluid communication directly between first volume 120A of shaft chamber 120, at sidewall 124 between end wall 125 and radial shaft seal 130, and low fluid-pressure region 81 of channel 65 at base 61 of annular housing 52 at the underside of impeller 51.

In regenerative blower-compressor 50D, port 210 is formed directly through the material of cover 60, such as by machining or drilling or the like, from sidewall 191, between radial shaft seal 200 and bearing 114C, and cover 60 at low fluid-pressure region 81 of channel 65 at the upper side of impeller 51, which thereby couples second volume 190B of shaft chamber 190 to channel 65 at low fluid-pressure region 81 in fluid communication. Port 210 is additionally configured with branch 210A similarly formed through the material of cover 60, which operatively couples first volume 190A in fluid communication with port 210 and thereby low fluid-pressure region 81 of channel 65. In this embodiment, branch 210A extends through the material of cover 60 from first volume 190A at sidewall 191 between impeller 51 and radial shaft seal 200 to port 210 between sidewall 191 of shaft chamber 190 and channel 65.

Port 210 is operatively connected in fluid communication between low fluid-pressure region 81 of channel 65 and first and second volumes 190A and 190B of shaft chamber 190 to constantly return/supply fluid from first and second volumes 190A and 190B of shaft chamber 190 and constantly supply it to low fluid-pressure region 81 of channel 65, whereby fluid constantly leaked to into first and second volumes 190A and 190B of shaft chamber 190 from high fluid-pressure region 82 of channel 65 is constantly returned/supplied by port 210 to into low fluid-pressure region 81 of channel 65 and thereby into the functional fluid path through channel 65 at low fluid-pressure region 81 of channel 65. Port 210 is a return port or re-vent coupled directly in fluid communication between first and second volumes 190A and 199B of shaft chamber 190 of cover 60 and low fluid-pressure region 81 of channel 65 for independently, directly, and constantly returning/venting leaked fluid, i.e. the bypass fluid leaked to into first and second volumes 190A and 190B of shaft chamber 190 from high fluid-pressure region 82. This directly couples first and second volumes 190A and 190B of shaft chamber 190 to channel 65 at low fluid-pressure region 81 in fluid communication enabling low fluid-pressure region 81 of channel 65 to receive fluid from first and second volumes 190A and 190B of shaft chamber 190 via port 210.

During operation of blower-compressor 50D, fluid in channel 65 constantly leaks through housing 55 through the inherent clearance between impeller 51 and annular volume 75 of housing 55 in the direction of arrow C from high fluid-pressure region 82 of channel 65 toward low fluid-pressure region 81 of channel 65 to shaft 70, and downwardly in the direction of arrow D through the inherent clearance between drive shaft 70 and hole 72 formed in head 96 to into first volume 120A of shaft chamber 120. Accordingly, first volume 120A of shaft chamber 120 constantly receives the so-called bypass fluid, the fluid that constantly leaks from high fluid-pressure region 82 to into first volume 120A of shaft chamber 120. Port 130 coupled directly in fluid communication between first volume 120A of shaft chamber 120 and low fluid-pressure region 81 of channel 65 at base 61 of annular housing 52 independently, directly, and constantly vents the leaked fluid from first volume 120A of shaft chamber 120 to into low fluid-pressure region 81 of channel 65 from base 61 and thereby to into the functional fluid flow through channel 65 at low fluid-pressure region 81 of channel 65. Accordingly, port 130 constantly and directly supplies/vents/ports the bypass fluid directly and independently from first volume 120A of shaft chamber 120 to into the fluid path of channel 65 through base 61 at low fluid-pressure region 81 of channel 65. This constant recirculation supply of the bypass fluid from first volume 120A shaft chamber 120 to into low fluid-pressure region 81 of channel 65 by port 130 advantageously increases the fluid flow through channel 65 thereby inherently improving the volumetric efficiency and operation of blower-compressor 50D as described above in connection with blower-compressor 50, and at the same time constantly relieves the pressure in first volume 120A of shaft chamber 120, which thereby arrests or at least reduces the pressure differential across radial shaft seal 140. This arrests or at least reduces lubricant loss from bearing 114B, and reduces the stress across radial shaft seal 140, thereby inherently improving the useful functional life of radial shaft seal 140, and across bearing 114B at second volume 120B of shaft chamber 120 to, in turn, thereby arrest or at least reduce lubricant loss from bearing 114B, according to the principle of the invention.

At the same time during operation of blower-compressor 50D, fluid in channel 65 constantly leaks through housing 55 through the inherent clearance between impeller 51 and annular volume 75 of housing 55 in the direction of arrow C from high fluid-pressure region 82 of channel 65 toward low fluid-pressure region 81 of channel 65 to shaft 70, and upwardly in the direction of arrow E to into first volume 190A of shaft chamber 190. Accordingly, first volume 190A of shaft chamber 190 constantly receives the so-called bypass fluid, the fluid that constantly leaks from high fluid-pressure region 82 to into first volume 190A of shaft chamber 120. As the pressure in first volume 190A increases, fluid can blow by radial shaft seal 200 from first volume 190A to into second volume 190B. Port 210 coupled directly in fluid communication between first and second volumes 190A and 190B of shaft chamber 190 and low fluid-pressure region 81 of channel 65 at base 61 of annular housing 52 independently, directly, and constantly concurrently vents the leaked fluid from first and second volumes 190A and 190B of shaft chamber 190 to into low fluid-pressure region 81 of channel 65 from base 61 and thereby to into the functional fluid flow through channel 65. Accordingly, port 210 constantly and directly supplies/vents/ports the bypass fluid directly and independently concurrently from first and second volumes 190A and 190B of shaft chamber 190 to into the fluid path of channel 65 through base 61 at low fluid-pressure region 81 of channel 65. This constant recirculation of the bypass fluid from first and second volumes 190A and 190B shaft chamber 190 to into low fluid-pressure region 81 of channel 65 advantageously increases the fluid flow through channel 65 thereby inherently improving the volumetric efficiency and operation of blower-compressor 50D as described above in connection with blower-compressor 50, and at the same time constantly relieves the pressure in first and second volumes 190A and 190B of shaft chamber 190, which thereby arrests or at least reduces the pressure differential across radial shaft seal 200. This arrests or at least reduces lubricant loss from bearing 114C, and reduces the stress across radial shaft seal 200, thereby inherently improving the useful functional life of radial shaft seal 140.

Although blower-compressor 50D has one return port 210 between shaft chamber and low fluid-pressure region 81 of channel 65, it can be formed with two or more separate supply ports 210 in alternate embodiments at different locations between shaft chamber 190 and along low fluid-pressure region 81 of channel 65. Although blower-compressor 50D has one return port 130 between shaft chamber 120 and low fluid-pressure region 81 of channel 65, it can be formed with two or more separate return ports in alternate embodiments at different locations between shaft chamber 120 and along low fluid-pressure region 81 of channel 65.

Those having ordinary skill in the art will readily appreciate that new and improved regenerative blowers-compressors with shaft bypass fluid re-vents are disclosed, which are simple in structure, and harvest and divert fluid from the high fluid-pressure region 82 of channel 65 to the low fluid-pressure region 81 of channel 65 for improving volumetric efficiency, relieving stress across radial shaft seals, and for arresting lubricant loss from the rotary bearings 114.

According to the principle of the invention, regenerative blower-compressor 50 includes impeller 51 mounted to drive shaft 70 within housing 55 including channel 65 extending from inlet 66 adjacent to low fluid-pressure region 81 of channel 65 to outlet 67 adjacent to high fluid-pressure region 82 of channel 65. Impeller 51 extends radially outward through annular volume 75 within housing 55 from drive shaft 70 to blades 80 in channel 65. Impeller 51 is configured to rotate for rotating blades 80 through channel 65 for forcing fluid through channel 65 from inlet 66 to outlet 67 in response to rotation of drive shaft 70. Drive shaft 70 extends from impeller 51 within annular volume 75 to into shaft chamber 120 within housing 55. Shaft chamber 70 is configured to receive fluid leaked through housing 55 to into shaft chamber 120 from high fluid-pressure region 82 of channel 65. Port 130 is coupled in fluid communication directly between shaft chamber 120 and low fluid-pressure region 81 of channel 65 for venting fluid directly from shaft chamber 65 to into low fluid-pressure region 81 of channel 65. Shaft chamber 120 is defined by sidewall 124 extending between end wall 125 and bearing 114B rotatably connecting drive shaft 70 to housing 55. In the embodiment of a regenerative blower denoted at 50A, drive shaft 70 is sealed to sidewall 124 by radial shaft seal 140 within shaft chamber 120 thereby dividing shaft chamber 120 into first volume 120A between end wall 125 and radial shaft seal 140 and second volume 120B between bearing 114B and radial shaft seal 140. First volume 120A is configured to receive fluid leaked through housing 55 to into first volume 120A from high fluid-pressure region 82 of channel 65, and port 130 is coupled in fluid communication directly between first volume 120A of shaft chamber 120 and low fluid-pressure region 81 of channel 65. First volume 120A is greater than second volume 120B.

According to the principle of the invention, another embodiment of a regenerative blower-compressor 50B includes impeller 51 mounted to drive shaft 70 within housing 55 including channel 65 extending from inlet 66 adjacent to low fluid-pressure region 81 of channel 65 to outlet 67 adjacent to high fluid-pressure region 82 of channel 65. Impeller 51 extends radially outward through annular volume 75 within housing 55 from drive shaft 70 to blades 80 in channel 65. Impeller 51 is configured to rotate for rotating blades 80 through channel 65 for forcing fluid through channel 65 from inlet 66 to outlet 67 in response to rotation of drive shaft 70. Drive shaft 70 extends from impeller 51 within annular volume 75 to into shaft chamber 120 within housing 55. Shaft chamber is defined by sidewall 124 extending between end wall 124 and bearing 114B rotatably connecting drive shaft 70 to housing 55. Drive shaft 70 is sealed to sidewall 124 by radial shaft seal 140 within shaft chamber 120 thereby dividing shaft chamber 120 into first volume 120A between end wall 125 and radial shaft seal 140 and second volume 120B between bearing 114B and radial shaft seal 140. First volume 120A is configured to receive fluid leaked through housing 55 to into first volume 120A from high fluid-pressure region 82 of channel 65. First port 150 is coupled in fluid communication directly between high fluid-pressure region 82 of channel 65 and second volume 120B for venting fluid directly from high fluid-pressure region 82 of channel 65 to into second volume 120B. Second port 130 is coupled in fluid communication directly between first volume 120A and low fluid-pressure region 81 of channel 65 for venting fluid directly from first volume 120A to into low fluid-pressure region of channel 65. First volume 120A is larger than second volume 120B.

According to the principle of the invention, yet another embodiment of a regenerative blower-compressor 50C includes impeller 51 mounted to drive shaft 70 within housing 55 including channel 65 extending from inlet 66 adjacent to low fluid-pressure region 81 of channel 65 to outlet 67 adjacent to high fluid-pressure region 82 of channel 65. Impeller 51 extends radially outward through annular volume 75 within housing 55 from drive shaft 70 to blades 80 in channel 65. Impeller 51 is configured to rotate for rotating blades 80 through channel 65 for forcing fluid through channel 65 from inlet 66 to outlet 67 in response to rotation of drive shaft 70. Drive shaft 70 extends from impeller 51 within annular volume 75 to into shaft chamber 120 within housing 55. First port 160 is coupled in fluid communication directly between high fluid-pressure region of channel 65 and shaft chamber 120 for venting fluid directly from high fluid-pressure region 82 of channel 65 to shaft chamber 120. Second port 130 is coupled in fluid communication directly between shaft chamber 120 and low fluid-pressure region 81 of channel 65 for venting fluid directly from shaft chamber 120 to into low fluid-pressure region 81 of channel 65.

According to the principle of the invention, still another embodiment of a regenerative blower-compressor 50C includes impeller 51 mounted to drive shaft 70 within housing 55 including channel 65 extending from inlet 66 adjacent to low fluid-pressure region 81 of channel 65 to outlet 67 adjacent to high fluid-pressure region 82 of channel 65. Impeller 51 extends radially outward through annular volume 75 within housing 55 from drive shaft 70 to blades 80 in channel 65. Impeller 51 is configured to rotate for rotating blades 80 through channel 65 for forcing fluid through channel 65 from inlet 66 to outlet 67 in response to rotation of drive shaft 70. Drive shaft 70 extends from impeller 51 within annular volume 75 to into shaft chamber 120 within housing 55. Shaft chamber 120 is defined by sidewall 124 extending between end wall 125 and bearing 114B rotatably connecting drive shaft 70 to housing 55. Drive shaft 70 is sealed to sidewall 124 by radial shaft seal 140 within shaft chamber 120 thereby dividing shaft chamber 120 into first volume 120A between end wall 125 and radial shaft seal 140 and second volume 120B between bearing 114B and radial shaft seal 140. First port 160 is coupled in fluid communication directly between high fluid-pressure region 82 of channel 65 and first volume 120A for venting fluid directly from high fluid-pressure region 82 of channel 65 to into first volume 120A. Second port 130 is coupled in fluid communication directly between first volume 120A and low fluid-pressure region 81 of channel 65 for venting fluid directly from first volume 120A to into low fluid-pressure region 81 of channel 65. Third port 150 is coupled in fluid communication directly between high fluid-pressure region 82 of channel 65 and second volume 120B for venting fluid directly from high fluid-pressure region 82 of channel 65 to into second volume 120B. Second port 130 is additionally coupled in fluid directly between second volume 120B and low fluid-pressure region of channel 65 for venting fluid directly from second volume 120B to into low fluid-pressure region 81 of channel 65. First volume 120A is larger than second volume 120B.

According to the principle of the invention, yet still another embodiment of a regenerative blower-compressor 50C includes impeller 51 mounted to drive shaft 70 within housing 55 including channel 65 extending from inlet 66 adjacent to low fluid-pressure region 81 of channel 65 to outlet 67 adjacent to high fluid-pressure region 82 of channel 65. Impeller 51 extends radially outward through annular volume 75 within housing 55 from drive shaft 70 to blades 80 in channel 65. Impeller 51 is configured to rotate for rotating blades 80 through channel 65 for forcing fluid through channel 65 from inlet 66 to outlet 67 in response to rotation of drive shaft 70. Drive shaft 70 extends from impeller 51 within annular volume 75 to into shaft chamber 120 within housing 55. Shaft chamber 120 is defined by sidewall 124 extending between end wall 125 and bearing 114B rotatably connecting drive shaft 70 to housing 55. Drive shaft 70 is sealed to sidewall 124 by radial shaft seal 140 within shaft chamber 120 thereby dividing shaft chamber 120 into first volume 120A between end wall 125 and radial shaft seal 140 and second volume 120B between bearing 114B and radial shaft seal 140. First port 150 is coupled in fluid communication directly between high fluid-pressure region 82 of channel 65 and second volume 120B for venting fluid directly from high fluid-pressure region 82 of channel 65 to into second volume 120B. Second port 130 is coupled in fluid communication directly between second volume 120B and low fluid-pressure region 81 of channel 65 for venting fluid directly from second volume 120B to into low fluid-pressure region 81 of channel 65. First volume 120A is larger than second volume 120B.

According to the principle of the invention, yet another embodiment of a regenerative blower-compressor 50D includes impeller 51 mounted to drive shaft 70 within housing 55 including channel 65 extending from inlet 66 adjacent to low fluid-pressure region 81 of channel to outlet 67 adjacent to high fluid-pressure region 82 of channel 65. Impeller 51 extends radially outward through annular volume 75 within housing 55 from drive shaft 70 to blades 80 in channel 65. Impeller 51 is configured to rotate for rotating blades 80 through channel 65 for forcing fluid through channel 65 from inlet 66 to outlet 67 in response to rotation of drive shaft 51. Drive shaft 70 extends from either side of impeller 51 within annular volume 75 to into first shaft chamber 190 and second shaft chamber 120 within housing on either side of impeller 51. First shaft chamber 190 and second shaft chamber 120 are each configured to receive fluid leaked through housing 55 to into first shaft chamber 190 and second shaft chamber 120 from high fluid-pressure region 82 of channel 65. First port 210 is coupled in fluid communication directly between first shaft chamber 190 and low fluid-pressure region 81 of channel 65 for venting fluid directly from the first shaft chamber 190 to into low fluid-pressure region 81 of channel 65. Second port 130 is coupled in fluid communication directly between second shaft chamber 120 and low fluid-pressure region 81 of channel 65 for venting fluid directly from second shaft chamber 120 to into low fluid-pressure region 81 of channel 65. First shaft chamber 190 is defined by sidewall 191 extending between impeller 51 and bearing 114C rotatably connecting drive shaft 70 to housing 55. Drive shaft 70 is sealed to sidewall 191 by radial shaft seal 200 within first shaft chamber 190 thereby dividing first shaft chamber 190 into a first volume 190A between impeller 51 and radial shaft seal 200 and second volume 190B between radial shaft seal 200 and bearing 114C. First volume 190A is configured to receive fluid leaked through housing 55 to into first volume 190A from high fluid-pressure region 82 of channel 65, and first port 210 is coupled in fluid communication directly between first volume 190A of first shaft chamber 190 and low fluid-pressure region 81 of channel 65. Second shaft chamber 120 is defined by sidewall 124 extending between end wall 124 and bearing 114B rotatably connecting drive shaft 70 to housing 55. Drive shaft 70 is sealed to sidewall 124 of second shaft chamber 120 by radial shaft seal 140 within second shaft chamber 120 thereby dividing second shaft chamber 120 into first volume 120A between end wall 125 and radial shaft seal 140 and second volume 120B between bearing 114B and radial shaft seal 140. First volume 120A is configured to receive fluid leaked through housing 55 to into first volume 120A from high fluid-pressure region 82 of channel 65, and second port 130 is coupled in fluid communication directly between first volume 120A of second shaft chamber 120 and low fluid-pressure region 81 of channel 65.

The present invention is described above with reference to illustrative embodiments. However, those skilled in the art will recognize that changes and modifications may be made in the described embodiments without departing from the nature and scope of the present invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A regenerative blower-compressor, comprising:

an impeller mounted to a drive shaft within a housing defining a channel extending from an inlet adjacent to a low fluid-pressure region of the channel to an outlet adjacent to a high fluid-pressure region of the channel, the impeller enclosed within and extends radially outward through an annular volume within the housing from the drive shaft to blades in the channel, the impeller configured to rotate for rotating the blades through the channel for forcing fluid through the channel from the inlet to the outlet in response to rotation of the drive shaft, the drive shaft extends from the impeller and out of the annular volume to into a shaft chamber within a head of the housing, the head extends outwardly from the shaft chamber to the channel outwardly of the shaft chamber, the head configured with a port, and the housing configured to constantly leak fluid as bypass fluid from the high fluid-pressure region of the channel to into the shaft chamber along a leak pathway through the housing, the leak pathway extending along the impeller in the annular volume from the high fluid-pressure region of the channel to the drive shaft and along the drive shaft from the impeller in the annular volume to into the shaft chamber;

the port extending outwardly through the head directly from the shaft chamber to the low fluid-pressure region of the channel, directly coupling the shaft chamber to the low fluid-pressure region of the channel in fluid communication for constantly diverting the bypass fluid directly away from the shaft chamber and the drive shaft therein to into the low fluid-pressure region of the channel along a return pathway bypassing the leak pathway;

the shaft chamber defined by a sidewall extending between an end wall and a bearing rotatably connecting the drive shaft to the housing;

the drive shaft sealed to the sidewall by a radial shaft seal within the shaft chamber thereby dividing the shaft chamber into a first volume between the end wall and the radial shaft seal and a second volume between the bearing and the radial shaft seal;

the first volume configured to receive fluid leaked through the housing to into the first volume from the high fluid-pressure region of the channel; and the port coupled in fluid communication directly between the first volume of the shaft chamber and the low fluid-pressure region of the channel.

2. The regenerative blower-compressor according to claim 1, wherein the first volume is greater than the second volume.

3. A regenerative blower-compressor, comprising:

an impeller mounted to a drive shaft within a housing including a channel extending from an inlet adjacent to a low fluid-pressure region of the channel to an outlet adjacent to a high fluid-pressure region of the channel, the impeller extends radially outward through an annular volume within the housing from the drive shaft to blades in the channel, the impeller is configured to rotate for rotating the blades through the channel for forcing fluid through the channel from the inlet to the outlet in response to rotation of the drive shaft, the drive shaft extends from the impeller within the annular volume to into a shaft chamber within the housing, the shaft chamber is defined by a sidewall extending between an end wall and a bearing rotatably connecting the drive shaft to the housing, the drive shaft is sealed to the sidewall by a radial shaft seal within the shaft chamber thereby dividing the shaft chamber into a first volume between the end wall and the radial shaft seal and a second volume between the bearing and the radial shaft seal, and the first volume is configured to receive fluid leaked through the housing to into the first volume from the high fluid-pressure region of the channel;

a first port coupled in fluid communication directly between the high fluid-pressure region of the channel and the second volume for venting fluid directly from the high fluid-pressure region of the channel to into the second volume; and a second port coupled in fluid communication directly between the first volume and the low fluid-pressure region of the channel for venting fluid directly from the first volume to into the low fluid-pressure region of the channel.

4. The regenerative blower-compressor according to claim 3, wherein the first volume is larger than the second volume.

5. A regenerative blower-compressor, comprising:

an impeller mounted to a drive shaft within a housing including a channel extending from an inlet adjacent to a low fluid-pressure region of the channel to an outlet adjacent to a high fluid-pressure region of the channel, the impeller extends radially outward through an annular volume within the housing from the drive shaft to blades in the channel, the impeller is configured to rotate for rotating the blades through the channel for forcing fluid through the channel from the inlet to the outlet in response to rotation of the drive shaft, the drive shaft extends from the impeller within the annular volume to into a shaft chamber within the housing, the shaft chamber is defined by a sidewall extending between an end wall and a bearing rotatably connecting the drive shaft to the housing, and the drive shaft is sealed to the sidewall by a radial shaft seal within the shaft chamber thereby dividing the shaft chamber into a first volume between the end wall and the radial shaft seal and a second volume between the bearing and the radial shaft seal;

a first port coupled in fluid communication directly between the high fluid-pressure region of the channel and the first volume for venting fluid directly from the high fluid-pressure region of the channel to the first volume; and a second port coupled in fluid communication directly between the first volume and the low fluid-pressure region of the channel for venting fluid directly from the first volume to into the low fluid-pressure region of the channel.

6. The regenerative blower-compressor according to claim 5, additionally comprising:

a third port coupled in fluid communication directly between the high fluid-pressure region of the channel and the second volume for venting fluid directly from the high fluid-pressure region of the channel to the second volume; and the second port additionally coupled in fluid directly between the second volume and the low fluid-pressure region of the channel for venting fluid directly from the second volume to into the low fluid-pressure region of the channel.

7. The regenerative blower-compressor according to claim 6, wherein the first volume is larger than the second volume.

8. A regenerative blower-compressor, comprising:

an impeller mounted to a drive shaft within a housing including a channel extending from an inlet adjacent to a low fluid-pressure region of the channel to an outlet adjacent to a high fluid-pressure region of the channel, the impeller extends radially outward through an annular volume within the housing from the drive shaft to blades in the channel, the impeller is configured to rotate for rotating the blades through the channel for forcing fluid through the channel from the inlet to the outlet in response to rotation of the drive shaft, the drive shaft extends from the impeller within the annular volume to into a shaft chamber within the housing, the shaft chamber is defined by a sidewall extending between an end wall and a bearing rotatably connecting the drive shaft to the housing, and the drive shaft is sealed to the sidewall by a radial shaft seal within the shaft chamber thereby dividing the shaft chamber into a first volume between the end wall and the radial shaft seal and a second volume between the bearing and the radial shaft seal;

a first port coupled in fluid communication directly between the high fluid-pressure region of the channel and the second volume for venting fluid directly from the high fluid-pressure region of the channel to the second volume; and a second port coupled in fluid communication directly between the second volume and the low fluid-pressure region of the channel for venting fluid directly from the second volume to into the low fluid-pressure region of the channel.

9. The regenerative blower-compressor according to claim 8, wherein the first volume is larger than the second volume.

* * * * *